US007008052B2

(12) United States Patent
Yamada et al.

(10) Patent No.: US 7,008,052 B2
(45) Date of Patent: Mar. 7, 2006

(54) INK JET PRINTER

(75) Inventors: Takahisa Yamada, Hachioji (JP); Takashi Matsuyama, Hachioji (JP); Masanobu Shimizu, Hachioji (JP); Kaoru Horie, Hachioji (JP); Keiji Izumi, Hino (JP); Hiroshi Hashi, Tokyo (JP); Toshihiro Kitahara, Tachikawa (JP); Takashi Miyazawa, Hachioji (JP)

(73) Assignee: Olympus Corporation, Tokyo (JP)

( * ) Notice: Subject to any disclaimer, the term of this patent is extended or adjusted under 35 U.S.C. 154(b) by 0 days.

(21) Appl. No.: 10/870,851

(22) Filed: Jun. 16, 2004

(65) Prior Publication Data

US 2004/0257410 A1 Dec. 23, 2004

Related U.S. Application Data

(63) Continuation of application No. PCT/JP02/13450, filed on Dec. 24, 2002.

(30) Foreign Application Priority Data

Dec. 21, 2001 (JP) ..... 2001-389853
Apr. 18, 2002 (JP) ..... 2002-116145

(51) Int. Cl.
*B41J 2/175* (2006.01)

(52) U.S. Cl. ..... 347/85; 347/86

(58) Field of Classification Search ..... 347/84–87, 347/20, 56, 63, 65, 67, 92, 93
See application file for complete search history.

(56) References Cited

U.S. PATENT DOCUMENTS 4,038,667 A * 7/1977 Hou et al. ..... 347/85
6,267,474 B1 * 7/2001 Mochizuki ..... 347/86

FOREIGN PATENT DOCUMENTS

| | | |
|---|---|---|
| EP | 1 106 363 A2 | 6/2001 |
| EP | 1 122 070 A2 | 8/2001 |
| JP | 55-142213 A | 6/1980 |
| JP | 8-20114 A | 1/1996 |
| JP | 9-131833 A | 5/1997 |
| JP | 2000-211152 A | 8/2000 |
| JP | 2001-260389 A | 9/2001 |

* cited by examiner

*Primary Examiner*—Juanita D. Stephens
(74) *Attorney, Agent, or Firm*—Frishauf, Holtz, Goodman & Chick, P.C.

(57) ABSTRACT

An ink jet printer includes ink jet heads for recording an image on a recording medium, an ink bottle for holding ink, an ink supply path connecting the ink bottle to each ink jet head, and an electromagnetic valve provided on the path. In the printer, the bottle, the valve and the heads are arranged downward in this order in the vertical direction, the path constantly exists upwards in the vertical direction in such a manner that air entered into the path moves up above the valve due to a difference in the specific gravity between the air and the ink, the path is provided with a branching portion provided between the valve and the heads, and a sub ink tank is provided at an end of the branching portion so as to be positioned lower than the heads in the vertical direction.

21 Claims, 21 Drawing Sheets

INK JET PRINTER

CROSS-REFERENCE TO RELATED APPLICATIONS

This is a Continuation Application of PCT Application No. PCT/JP02/13450, filed Dec. 24, 2002, which was not published under PCT Article 21(2) in English.

This application is based upon and claims the benefit of priority from prior Japanese Patent Applications No. 2001-389853, filed Dec. 21, 2001; and No. 2002-116145, filed Apr. 18, 2002, the entire contents of both of which are incorporated herein by reference.

BACKGROUND OF THE INVENTION

1. Field of the Invention

The present invention relates to an ink jet printer.

2. Description of the Related Art

An ink jet printer replenishes an ink jet head (recording head) with ink by using a high-capacity ink bottle as an ink supply source. Specifically, ink in an ink bottle is supplied to a small-capacity sub tank or an ink reservoir through a flexible tube. The ink in the sub tank or the ink reservoir is supplied to the recording head.

This above-described type of ink jet printer is disclosed in, e.g., Jpn. Pat. Appln. KOKAI Publication No. 2001-260389. The ink jet printer in the above-described publication has a supply pump used to supply the ink in the ink bottle to the sub tank. Further, the ink jet printer has ink sucking means for filling the ink in the recording head.

The ink sucking means is provided in a maintenance area which is a non-recording area. This ink sucking means has a cap which seals a nozzle formed surface of the recording head and a pump which forms a negative pressure in a space in the cap. Furthermore, this ink sucking means can be moved between a cap position and a non-cap position by driving of cap driving means. The cap position is a position at which the ink sucking means is pressed against a nozzle surface of the recording head. The non-cap position is a position at which the ink sucking means is separated from the nozzle surface of the recording head.

In the ink jet printer in the above-described publication, when filling the ink in the recording head, the recording head is moved to a position where the ink sucking means exists. Subsequently, the cap driving means moves the cap of the ink sucking means to the cap position. The cap caps the nozzle surface by this movement. After completion of capping, the ink sucking means drives a suction pump. This suction pump sucks the ink from the sub tank by forming a negative pressure in the cap. By this suction, the ink is filled in the recording head, and air or air bubbles existing in the recording head are discharged from the recording head.

Users of the ink jet printer in recent years very strongly expect an improvement in throughput. Therefore, the number of nozzles per recording head of the ink jet printer tends to be increased. Moreover, in the ink jet printer, there is also used a recording head in which the number of nozzles per unit obtained by forming a unit by connecting a plurality of recording heads is increased.

Such a recording head or recording head unit has a dimension which is large in a nozzle column direction. Therefore, in order to cap the nozzle column, the cap of the ink sucking means must be also increased in size. However, if a dimension of the cap is increased, the press of the cap with respect to the nozzle surface of the recording head is lowered. Therefore, the ink sucking means with the large cap dimension cannot excellently fill the ink in the recording head, and it may not excellently remove air or air bubbles in the recording head.

Additionally, the ink jet printer in the above-described publication requires various kinds of pumps such as a supply pump used to supply the ink or a suction pump used to fill the ink in the recording head. That is, the ink jet printer in the above-described publication has an inconvenience that the number of components is increased.

Further, the various kinds of pumps may possibly generate bubbles such as air bubbles in the ink by a pumping operation. If the bubbles reach the inside of the recording head, they may possibly generate a discharge failure of the ink in the recording head.

In view of the above-described drawbacks, it is an object of the present invention to provide an ink jet printer which can fill ink in an ink supply path and remove air in the ink supply path without comprising ink sucking means for sucking ink from an ink bottle or a sub tank and filling the ink in the ink supply path.

Furthermore, it is another object of the present invention to provide an ink jet printer which can supply ink to a sub tank or an ink head without comprising the supply pump which supplies ink from an ink bottle.

BRIEF SUMMARY OF THE INVENTION

To achieve these objects, an ink jet printer according to the present invention has the following structure.

An ink jet printer according to one aspect of the present invention comprises: a plurality of ink jet heads which record an image on a recording medium by ejecting ink; an ink bottle in which the ink to be supplied to the ink jet heads is filled; an ink supply path by which the ink bottle is connected with the ink jet head in such a manner that the ink can flow therebetween; and an electromagnetic valve which is provided on the ink supply path and makes the ink path between the ink bottle and the ink jet head being capable of opening and closing. In the ink jet printer, the ink bottle, the electromagnetic valve and the ink jet head are arranged downward in this order in the vertical direction, the ink supply path constantly exists upward in the vertical direction in such a manner that air which has entered into the ink supply path moves up above the electromagnetic valve due to a difference in the specific gravity between the air and the ink, the ink supply path is provided with a branching portion provided between the electromagnetic valve and the ink jet heads, and a sub ink tank is provided at an end of the branching portion so as to be positioned lower than the ink jet heads in the vertical direction.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments according to the present invention will now be described hereinafter with reference to the accompanying drawings.

FIRST EMBODIMENT

Figure 1:
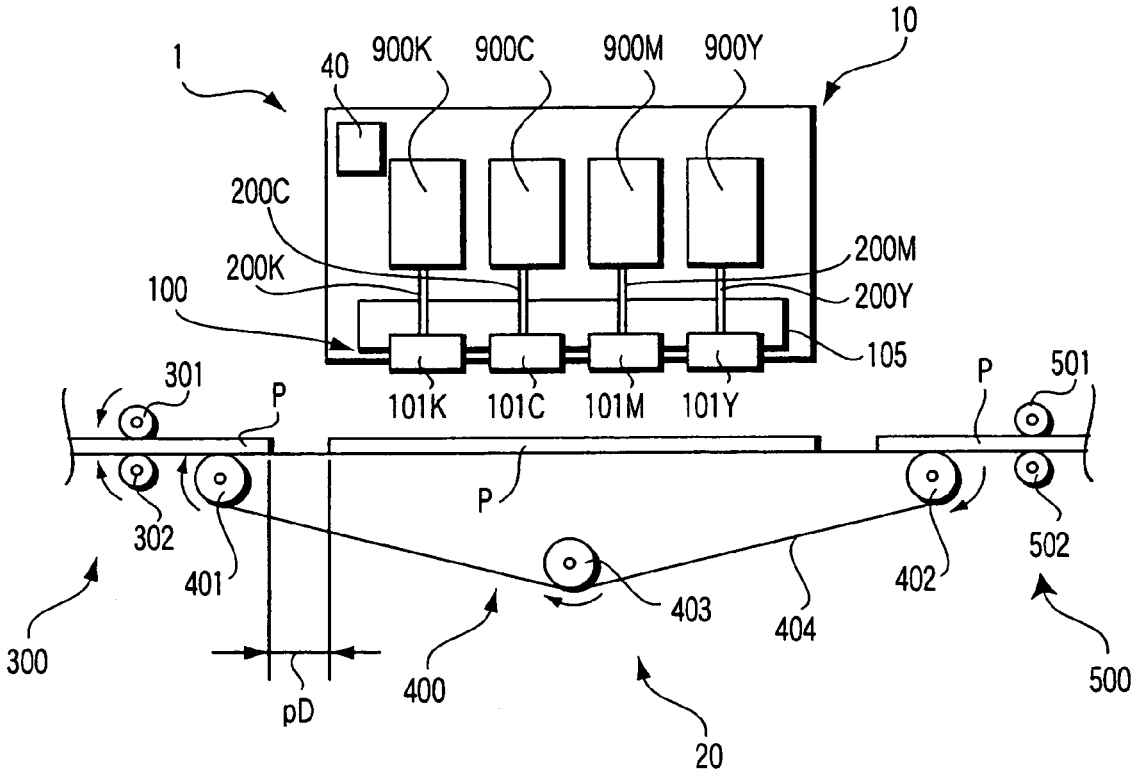
FIG. 1 is a schematic view showing an ink jet printer according to a first embodiment as seen from an operation side.
Figure 2:
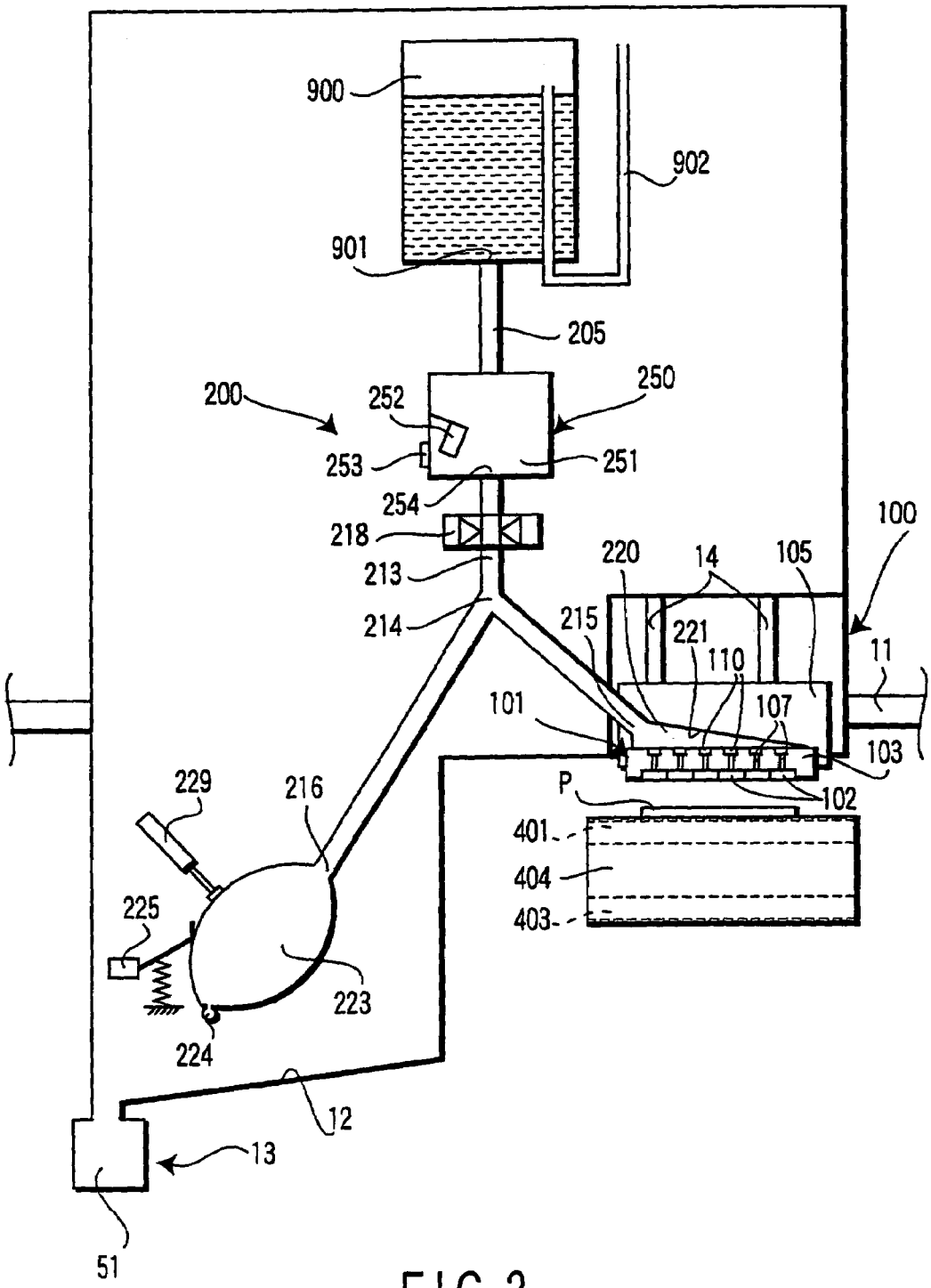
FIG. 2 is a view showing a schematic structure of a movable body when seeing the ink jet printer from its side (in a paper carriage direction)
Figure 3A:
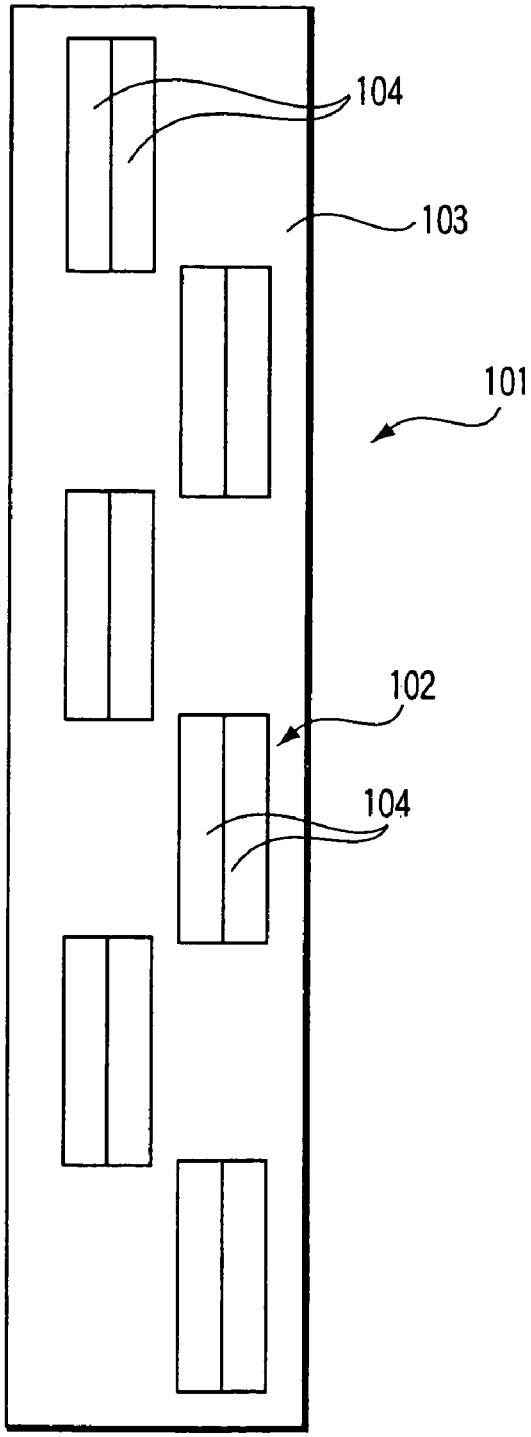
FIG. 3A is a view showing a structure of a recording head unit.
Figure 3B:
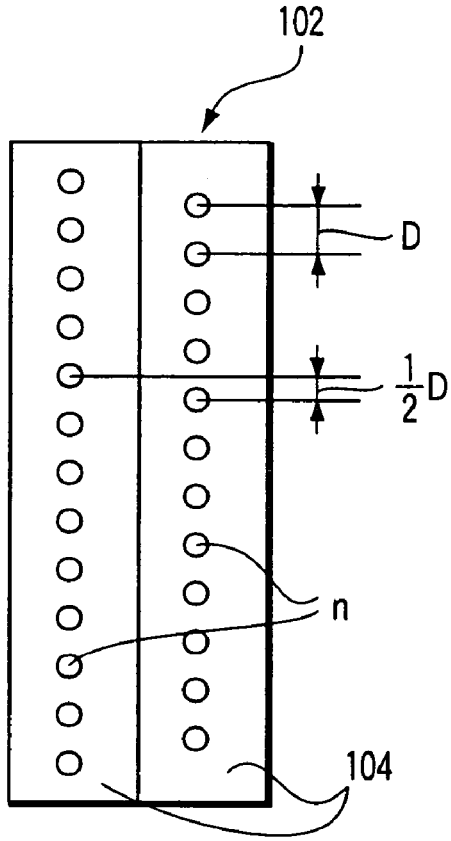
FIG. 3B is a view showing a structure of an ink jet head.
Figure 4:
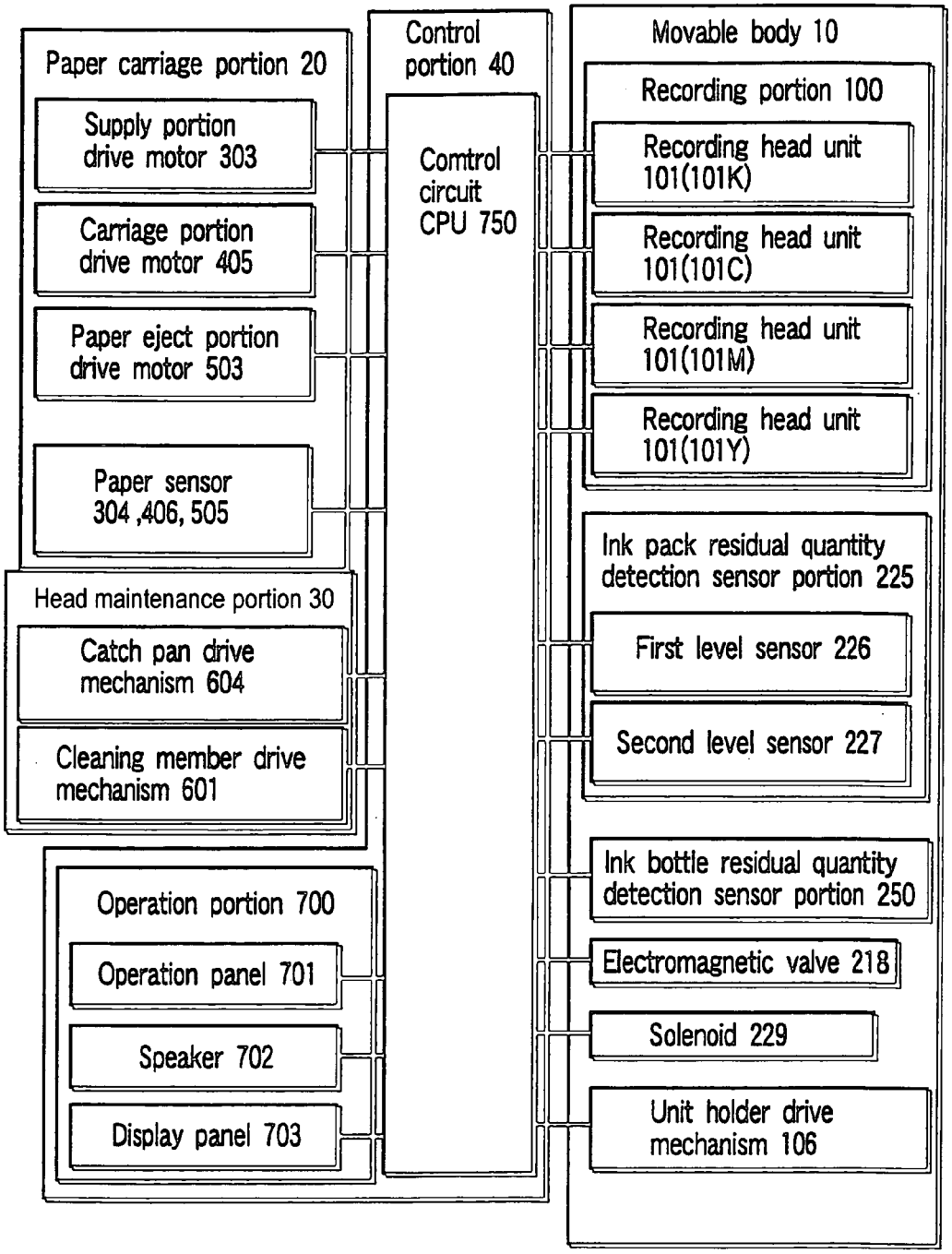
FIG. 4 is a function block diagram of constituent elements of the printer.

An ink jet printer according to a first embodiment will now be described with reference to FIGS. 1 to 4. FIG. 1 is a schematic view when an ink jet printer according to this embodiment is seen from an operation side. FIG. 2 is a schematic view showing a movable body when seen from a side (in a paper carriage direction) of the ink jet printer in FIG. 1. FIG. 3A is a view which shows a structure of a recording head unit. FIG. 3B is a view showing a structure of an ink jet head (which will be referred to as a recording head hereinafter) in FIG. 3A. FIG. 4 is a function block diagram of constituent elements of the ink jet printer according to this embodiment.

An ink jet printer 1 in this embodiment comprises a movable body 10, a paper carriage portion 20, a head maintenance portion 30 (see FIG. 4) and a control portion 40.

First, the control portion 40 will be explained. The control portion 40 is connected with the movable body 10, the paper carriage portion 20 and the head maintenance portion 30, and controls driving of these members. This control portion 40 has a control circuit CPU 750 and an operation portion 700 as shown in FIG. 4.

The control circuit CPU 750 has a counter and a memory. This control circuit CPU 750 obtains information from later-described various kinds of sensors and outputs drive commands to the movable body 10, the paper carriage portion 20 and the head maintenance portion 30.

The operation portion 700 has an operation panel 701, a speaker 702 and a display panel 703. Moreover, the operation portion 700 is connected with the control circuit CPU 750.

The speaker 702 and the display panel 703 outputs a status of the ink jet printer 1 such as an ink residual quantity or any other information in response to a command from the control circuit CPU 750. The operation panel 701 is operated by a user, and transmits a command corresponding to the operation to the control circuit CPU 750.

The movable body 10 will now be described with reference to FIGS. 1 and 2.

The movable body 10 has a recording portion 100 used to record an image with respect to a recording medium P, an ink supply path 200 used to supply ink to the recording portion 100, an ink bottle 900 as a supply source of the ink, and a waste ink bottle 51 used to collect waste ink. The recording portion 100 and the ink bottle 900 are connected with each other through the ink supply path 200 as an ink path. It is to be noted that the ink bottle 900, the ink supply path 200 and the recording portion 100 are arranged downward in this order in the movable body 10 in the vertical direction. Therefore, the ink in the ink bottle 900 can be supplied to the recording portion 100 by its own weight without being pushed out by using, e.g., a pump.

The movable body 10 is supported by a horizontal guide rail 11 supported by a non-illustrated housing of the ink jet printer. The horizontal guide rail 11 extends in a direction orthogonal to the paper carriage direction. The movable body 10 can move in back and fourth directions (right and left directions in FIG. 2) of the ink jet printer 1 along the horizontal guide rail 11.

The recording head 100 has at least one recording head unit 101 and a recording head unit holder 105. In this embodiment, the recording portion 100 has the recording head units 101 for four colors, i.e., black (K), cyan (C), magenta (M) and yellow Y). These recording head units 101 for black, cyan, magenta and yellow are respectively denoted by reference numerals 101K, 101C, 101M and 101Y for explanation in FIG. 1. The respective recording head units 101 are attached to the common recording head unit holder 105 in such a manner that they are arranged in the order of black (K), cyan (C), magenta (M) and yellow (Y) from an upstream side in the paper carriage direction as shown in FIG. 1.

As shown in FIG. 4, each recording head unit 101 is connected with the control circuit CPU 750. Driving of each recording head unit 101 is controlled by the control circuit CPU 750.

Further, each recording head unit 101 has a plurality of recording heads 102 and a head holder 103 which holds the plurality of recording heads 102. In this embodiment, each recording head unit 101 has six recording heads 102.

As shown in FIG. 3B, the recording head 102 has two head elements 104. More specifically, the recording head 102 is formed by attaching these head elements 104 in such a manner that a position of a nozzle n of one head element 104 is shifted by an amount (½D) corresponding to a half of a nozzle pitch (D) of the other head element 104. For example, when two head elements whose resolution is 150 DPI are attached, a resolution per recording head is 300 DPI. That is, a resolution is increased as compared with one head element 104.

As shown in FIG. 3A, six recording heads 102 are attached to the head holder 103 in a zigzag form. It is to be noted that a gap between a nozzle n at an end portion of a nozzle column of each recording head 102 and a nozzle n at an end portion of a nozzle column of an adjacent recording head 102 in an arrangement direction of the nozzle column corresponds to a ½ nozzle pitch in a direction orthogonal to the paper carriage direction (upper and lower directions in FIG. 3).

When the six recording heads 102, i.e., the 12 head elements 104 are arranged in the head holder 103 in this manner, a length of the nozzle column of each recording head unit 101 substantially matches a paper width of a paper sheet P or a length in a longitudinal direction of the same. Each of such recording head units 101 can form an image along the paper widthwise direction without scanning in the paper widthwise direction or the longitudinal direction. That is, the recording head unit 101 can demonstrate a function as a full-line head which can form an image with a resolution of 300 DPI.

Furthermore, the recording head unit 101 has a plurality of ink tubes 107 and filters 110. The ink tube 107 connects each head element 104 with a later-described ink pool 220 (see FIG. 2) which is common to respective colors. The filter 110 is arranged between this ink tube 107 and the ink pool 220. Specifically, an end portion of the ink tube 107 on the ink pool 220 side (ink pool side end portion) is connected with the ink pool 220 through the filter 110. Therefore, the ink in the ink pool 220 can be supplied to each head element 104 through the filter 110 and the ink tube 107.

The ink tube 107 will now be described hereinafter in detail. The ink tube 107 has a narrow tube diameter. Specifically, an inner diameter of the ink tube 107 is narrower than an inner diameter of a later-described ink supply path 200 (see FIG. 2). More specifically, the ink tube 107 is formed to be extremely narrow with respect to the inner diameter of each of a later-described ink tube 205 and a trifurcate ink tube 213 (see FIG. 2), and has a high flow resistance to the ink.

The inventors confirmed that the ink tube can readily perform the flow of the ink and air when the inner diameter of the ink tube is not less than 6 mm. That is, if the inner diameter of the ink tube is not less than 6 mm, the ink tube has a low flow resistance to the ink. On the contrary, when the inner diameter of the ink tube is smaller than 6 mm, the flow resistance of the ink tube is high. Therefore, the inner diameter of the ink tube 107 is preferably set to be smaller than 6 mm. It is to be noted that easiness of the flow of the ink and air concerns the viscosity of the ink, and hence the inner diameter of the ink tube 107 is arbitrary as long as the flow resistance can be set higher than those of the ink tube 205 which will be described later and the trifurcate ink tube 213.

The filter 110 is a known filter which removes impurities such as foreign particles in the ink.

It is to be noted that air attached to/entered in the filter must be removed in order to prevent air from adversely affecting printing. As described above, the narrow ink tube 107 has the high flow resistance to the ink by extremely narrowing the inner diameter thereof. Therefore, air on the ink pool 220 side in the filter 110 is hard to move to the ink tube 107 side. The area of a surface of the filter 110 opposed to the ink pool 220 is formed to be larger than the area of a circle having a diameter of 6 mm. Therefore, the filter 110 can reduce a flow path resistance on the ink pool side and move the air to the ink pool 220 side.

It is to be noted that air or air bubbles in this narrow ink tube 107 on the ink tube 107 side in the filter 110 or in the ink flow path in each head element 104 can be pushed out by the ink supplied from the ink pool 220 and can be discharged from the nozzles.

That is, air on the ink pool 220 side in the filter 110 can be discharged to the upstream side of the ink path. Additionally, air existing on a downstream side of the ink path away from the filter in the ink pool 220 is discharged from the nozzles of each head element 104.

It is to be noted that the term "recording portion" is a generic term for constituent elements on the downstream side of the filter 110 in an ink supply direction in this specification.

As shown in FIG. 1, the recording head unit holder 105 holds all the recording head units 101. The recording head unit holder 105 is supported by vertical guide rails 14 provided to the movable body 10 so as to be capable of moving in the upper and lower directions with respect to the movable body 10. Further, the recording head unit holder 105 has a non-illustrated drive mechanism 106. The recording head unit holder 105 is driven up and down along the vertical guide rails 14 by the drive mechanism 106. It is to be noted that the recording head unit holder 105 escapes from a recordable position, at which an image recording is performed, by moving up. Furthermore, the recording head unit holder 105 is arranged at the recordable position by moving down. It is to be noted that the above-described operation of the recording head unit holder 105 can be operated by, e.g., a non-illustrated cam lever or the control portion 40.

The ink bottle 900 holds the ink and supplies the ink to the ink supply path 200. In this embodiment, the ink jet printer performs four-color printing. Therefore, the ink bottle 900 is provided with respect to each of four different colors. It is to be noted that the ink bottles corresponding to the respective colors, i.e., black, cyan, magenta and yellow are denoted by reference numerals 900K, 900C, 900M and 900Y in FIG. 1 for explanation.

As shown in FIGS. 1 and 2, the ink bottle 900 is arranged above each corresponding recording head unit 101 in the vertical direction. In other words, the ink bottle 900 is arranged at an upper portion of the movable body 100 as shown in FIG. 2. These ink bottles 900 are independently and detachably attached to the movable body 10, and can be replaced with new ink bottles when a residual quantity of the ink in each thereof is small.

The ink bottle 900 has an outlet member 901 at a lower portion thereof. The outlet member 901 is connected with the ink supply path 200. Furthermore, the ink bottle 900 has a ventilation tube 902. The ink in the ink bottle 900 can be discharged from the outlet member by its own weight since the inside of the ink bottle is ventilated by the tube.

The movable body 10 has an inclined bottom surface 12. A waste ink reservoir portion 13 is formed at a lowest position of the bottom surface 12, and the waste ink bottle 51 used to hold the waste ink is arranged. Therefore, even if an ink leak is generated somewhere in the ink supply path 200 and the ink bottle 900, the leaked ink can be received by the bottom surface 12. Therefore, the bottom surface 12 prevents the leaked waste ink from falling on the paper carriage portion 20 or the lower portion of the ink jet printer 1.

The waste ink which fell on the bottom surface 12 flows downward along the inclined bottom surface 12, and is collected in the waste ink reservoir portion 13. Then, the waste ink is held in the waste ink bottle 51. An ink absorption member such as a sponge can be provided in the waste ink reservoir portion 13 in place of the waste ink bottle 51. In this case, removal of the waste ink stored in the waste ink reservoir portion 13 can be facilitated by use of the ink absorption member.

The ink supply path 200 is a generic name for constituent elements which are used to supply the ink in the ink bottle 900 to the recording portion 100. That is, the ink supply path 200 is an ink leading path which leads the ink from the ink bottle 900 to the recording portion 100. In this embodiment, the ink supply path 200 indicates an ink path from the ink bottle 900 to the upstream side of the filters 110. This ink supply path 200 is fixed in the movable body 10 so as to be positioned above the bottom surface 12 of the movable body 10.

Each constituent element of the ink supply path 200 will now be described hereinafter. The ink supply path 200 has the ink tube 205, an ink bottle residual quantity detection sensor portion 250, the trifurcate ink tube 213, an electromagnetic valve 218, the ink pool 220, and an ink pack 223.

One end of the ink tube 205 is connected with the outlet member of the ink bottle 900, and the other end of the same is connected with the ink bottle residual quantity detection sensor portion 250. The ink tube 205 leads the ink from the ink bottle 900 to the ink bottle residual quantity detection sensor portion 250. Therefore, it is desired that the ink tube 205 readily permits the flow of the ink and air. Therefore, it is preferable that the inner diameter of the ink tube 205 is smaller in the flow path resistance for the ink and air. When the flow path resistance is small, a sufficient quantity of ink can be supplied to the recording heads 102, and air or air bubbles which have entered into the ink path can be naturally discharged to the ink bottle 900 by a difference in the specific gravity between the air or air bubbles and the ink. It is to be noted that air or air bubbles discharged to the ink bottle 900 are discharged to the outside through the tube 902. Although described above, the inventors confirmed that supply of the ink and discharge of air are excellently performed when the inner diameter of the ink tube is not less than 6 mm. Therefore, it is preferable for the inner diameter of the ink tube 205 to be not less than 6 mm.

Further, as a material of the ink tube 205, a material with high wettability, in other words, low water repellency, e.g., polyethylene is preferable in order to reduce the flow path resistance on the inner surface.

Furthermore, although the ink tube 205 is arranged so as to be in parallel with the vertical direction in FIG. 2, it may be arranged so as to have an angle with respect to the vertical direction in order to reduce the flow path resistance for the ink and air.

The ink bottle residual quantity detection sensor portion 250 has an ink tank 251, a float 252 provided on a wall surface of the ink tank 251 so as to be capable of swiveling, an ink bottle residual quantity detection sensor 253 which detects a position of the float 252, and an ink outlet 254. Moreover, the ink bottle residual quantity detection sensor portion 250 is connected with the control circuit CPU 750, and driving of this sensor portion is controlled by the control circuit CPU 750. Additionally, the ink bottle residual quantity detection sensor portion 250 supplies a detection result obtained by the ink bottle residual quantity detection sensor 253 to the control circuit CPU 750.

The float 252 is configured in such a manner that its height position is displaced in accordance with an ink quantity in the ink tank 251. The float 252 is displaced to a lower position as the ink in the ink tank 251 is decreased. Further, when the float 252 reaches a detectable position of the ink bottle residual quantity detection sensor 253, the ink bottle residual quantity detection sensor 253 detects the float. When the ink bottle residual quantity detection sensor 253 detects the float, it outputs a signal for indicating insufficiency of the ink to the control circuit CPU 750 as a detection output signal. The ink bottle residual quantity detection sensor 253 outputs a signal for indicating that the ink still remains to the control circuit CPU 750 when the float 252 exists at a position other than the detectable position.

The ink outlet 254 of the ink bottle residual quantity detection sensor portion 250 is connected with the trifurcate ink tube 213.

The trifurcate ink tube 213 has three end portions and an ink tube branching portion 214. One of the three end portions is connected with the ink outlet 254 as described above, and one of the two remaining end portions (an ink pool side end portion 215) is connected with the recording portion 100 while the other one (an ink pack side end portion 216) is connected with the ink pack 223.

Furthermore, the trifurcate ink tube 213 is configured to have a low ink flow resistance so that the ink and air can flow. Therefore, it is preferable that the trifurcate ink tube 213 have an inner diameter not less than 6 mm like the ink tube 205, is formed of a material with the high wettability, and is inclined with respect to the vertical direction.

The electromagnetic valve 218 opens and closes the ink flow path. This electromagnetic valve 218 is fixed to the movable body 10, and arranged between the ink bottle residual quantity detection sensor portion 250 and the ink tube branching portion 214 of the trifurcate ink tube 213. Moreover, the electromagnetic valve 218 is arranged between the ink bottle residual quantity detection sensor 250 and a nozzle position of each head element 104, in the horizontal direction.

This electromagnetic valve 218 is connected with the control circuit CPU 750 of the control portion 40. This electromagnetic valve 218 opens and closes the ink tube 213 on a basis of a signal from the control circuit CPU 750. That is, supply of the ink from the ink bottle 900 is controlled by the control portion 40. In this embodiment, since the inside of the ink bottle is ventilated, the ink can be discharged from the ink bottle 900 by its own weight. Therefore, the ink can be supplied to the recording portion 100 when the electromagnetic valve 218 is opened, and the supply of the ink can be stopped when the electromagnetic valve 218 is closed.

The control circuit CPU 750 closes the electromagnetic valve 218 when it receives the signal for indicating that there is no ink residual quantity from the ink bottle residual quantity detection sensor portion 250. That is, the electromagnetic valve 218 can be opened only when the control circuit CPU 750 receives the signal for indicating that the ink still remains from the ink bottle residual quantity detection sensor portion 250.

The ink pool 220 is arranged between the ink tube branching portion 214 and the recording portion 100. In this embodiment, the ink pool 220 is arranged between the filters 110 and the ink tube branching portion 214. This ink pool 220 is connected with the respective head elements 104 through the filters 110 and the ink tubes 107, and enables the supply of the ink to them.

A ceiling 221 of the ink pool 220 is an inclined surface. A gradient of this ceiling 221 is preferably set at three degrees or above with respect to the horizontal plane in order to reduce the flow path resistance. The ink pool side end portion 215 of the trifurcate ink tube 213 is connected with an uppermost portion of this inclined surface in the vertical direction.

The ink supply path 200 extends in such a manner that a part between the ink pool side end portion 215 and the ink tube branching portion 214 is constantly directed upward in the vertical direction as seen from the ink pool 220 side. Likewise, a part of the ink supply path 200 between the ink tube branching portion 214 and the ink bottle 900 extends so as to be constantly directed upward in the vertical direction. With the above-described structure, air or air bubbles which have entered into the ink pool 220 together with the ink move toward the upper ink bottle 900 due to a difference in the specific gravity between the air or air bubbles and the ink.

Further, the ink supply path 200 extends in such a manner that the ink tube 205 and the trifurcate ink tube 213 are constantly directed downward in the vertical direction as seen from the ink bottle 900 side. Therefore, the ink in the ink bottle 900 can be supplied to the ink pool arranged below due to its own weight.

On the other hand, the ink pack 223 as a sub tank is connected with the ink back side end portion 216.

The ink pack 223 is an ink container sealed by a flexible film. Therefore, the ink pack 223 expands and contracts depending on an ink quantity accommodated therein. That is, the flexible ink pack 223 expands when the ink is filled therein. A limit capacity by which a fracture does not occur due to this expansion is determined as 100%. Since the ink pack 223 contracts when the ink is filled in the ink pack 223 to the limit capacity, a positive pressure is applied to the ink in the ink pack. Furthermore, when the quantity of the ink in the ink pack 223 is not more than approximately 90% of the capacity, the ink in the ink pack is maintained in a state that a pressure which is substantially equivalent to the atmospheric pressure is applied thereto.

In order to ensure an excellent water head value in the nozzle of each head element 104, this ink pack 223 is fixed to the movable body 100 so as to be arranged below the electromagnetic valve 218 and the nozzle position of each head element 104, in the vertical direction.

An ink pack residual quantity detection sensor portion 225 which detects an ink residual quantity in the ink pack 223 from its expansion and a solenoid 229 which pushes the ink pack from the outside to discharge the ink in the ink pack are provided around this ink pack 223.

The solenoid 229 is connected with the control circuit CPU 750 as shown in FIG. 4, and its driving is controlled by the control circuit CPU 750.

The ink pack residual quantity detection sensor 225 comprises a first level sensor 226 and a second level sensor 227. The ink pack residual quantity detection sensor 225 is connected with the control circuit CPU 750 as shown in FIG. 4, and supplies detection results of the first level sensors 226 and 227 to the control circuit CPU 750.

The flexible ink pack 223 expands when filled with the ink. The first level sensor 226 detects whether the quantity of the ink filled in the pack is 80% of the capacity (a first detection level) or not from an expansion state of the ink pack 223. The second level sensor 227 likewise detects whether the quantity of the ink filled in the pack is 30% of the capacity (a second detection level) or not from the expansion state of the ink pack 223.

Moreover, the ink pack 223 has a capture portion 224 which is used to store a sludge-like ink, at a lower portion thereof. The sludge-like ink adversely affects ejection of the ink by the recording heads 102. The capture portion 224 prevents the sludge-like ink from being supplied to the recording heads 102. When the sludge-like ink having a relatively high specific gravity is supplied into the ink pack 223, it flows into the capture portion 224 and stored therein. Therefore, the ink pack 223 can prevent the sludge-like ink from being supplied to the recording heads 102.

A part of the ink tube 213 between the ink pack side end portion 216 and the ink tube branching portion 214 and a part of the ink tube 205 between the ink tube branching portion 214 and the ink bottle 900 are arranged in such a manner that the parts of the ink tubes 213 and 205 are constantly directed upward in the vertical direction as seen from the ink pack 223 side. Therefore, for example, even if air or air bubbles exist together with the ink in the ink pack 223, the air or air bubbles can move upward and reach the ink bottle 900 due to a difference in the specific gravity between the ink and the air or air bubbles.

The ink supply path 200 is arranged in such a manner that the ink tube 205 and the ink tube 213 are constantly directed downward in the vertical direction as seen from the ink bottle 900 side. Therefore, the ink jet printer 1 in this embodiment can supply the ink in the ink bottle 900 toward the ink pack 223 by utilizing its own weight.

Additionally, although the ink path from the ink bottle 900 to the ink tube branching portion 214 is arranged so as to be in parallel with the vertical direction in FIG. 2, the ink path may be arranged to have an angle with respect to the vertical direction in order to reduce the flow path resistance for the ink and air.

(Paper Carriage Portion)

The paper carriage portion 20 used to carry the recording medium P will now be described hereinafter.

As shown in FIG. 1, the paper carriage portion 20 has a supply portion 300 which carries the recording medium P to a carriage portion 400, the carriage portion 400 which carries the recording medium P in a recording area at a fixed speed, and a paper ejection portion 500 which discharges the recording medium P on which recording of an image is completed in the recording area.

The supply portion 300 has a pair of pickup rollers (not shown) which pick up a plurality of stacked cut sheet type paper sheets one by one, a supply roller 301 and a pinch roller 302 which are positioned on a downstream side of the pickup rollers and supply the paper sheet to the carriage portion 400, and a drive motor 303 which is used to drive the supply roller 301.

The carriage portion 400 has two pulleys 401 and 402, one tension pulley 403, an endless belt 404 stretched between these pulleys, and a drive motor 405 which rotates the pulley 401 on the upstream side.

The endless belt 404 has a width which can cover a widthwise dimension of a maximum paper sheet used in the ink jet printer 1. The endless belt 404 holds the supplied paper sheet by using its own belt surface. An upper surface of the endless belt 404 is set in such a manner that a gap between itself and a nozzle surface of each recording head 102 keeps approximately 1 to 2 mm.

The paper ejection portion 500 has a paper ejection roller 501 and a pinch roller 502 which are used to discharge the paper sheet, and a drive motor 503 which is used to drive the paper ejection roller 501.

As described above, the paper carriage portion 20 is connected with the control circuit CPU 750, and driving of the paper carriage portion 20 is thereby controlled. The control circuit CPU 750 controls a carriage speed of the endless belt 404, i.e., a carriage speed of the recording medium P by controlling rotation of the drive motor 405. Sensors (304, 406, 505 (see FIG. 4)) which detect presence/absence or a position of each recording medium P are provided to respective paper carriage paths (the supply portion 300, the carriage portion 400 and the paper ejection portion 500) of the paper carriage portion 20.

(Maintenance Portion)

The maintenance portion has a cleaning member which is, e.g., a sponge which wipes off the ink adhering on the nozzle surface of each recording head 102, a cleaning member drive mechanism 601 which moves the cleaning member along the nozzle surface, a catch pan 630 which can be inserted to a lower part of the recording portion 100 in order to avoid contaminations due to a drop of the ink from the nozzle surface, and a catch pan drive portion 604 which drives this catch pan. The cleaning member is, e.g., the sponge.

The catch pan 630 is a flat plate having an area which can sufficiently cover the entire recording area of the recording head units 101 for four colors. Further, the catch pan 630 is supported by a frame (not shown) of the ink jet printer 1 so as to be capable of moving between the recording area and a non-recording area in a space between the carriage portion 400 and the recording portion 100. A shape of the catch pan 630 is arbitrary as long as the catch pan 630 can cover the entire recording area so as to avoid contamination due to ink drops.

This catch pan 630 is moved to the recording area from the non-recording area by the catch pan drive portion 604 when there is a possibility that a drop of the ink may fall from the nozzle surface. In other words, the catch pan 630 is moved to a position facing the recording portion 100 placed at the recordable position. Generally, ink drops may fall at the time of movement of the movable body 10 during maintenance of the recording head units 101, replacement of the ink bottle 900, initial filling of ink into the recording heads 102 or the like.

Furthermore, the catch pan 630 has a non-illustrated sensor which detects whether it is moved to the recording area or not. This sensor is connected with the control circuit CPU 750. This sensor transmits a signal to the control circuit CPU 750 when it detects completion of movement of the catch pan 630.

The catch pan 630 is connected with the waste ink bottle 51. Therefore, the waste ink dropped and held on the catch pan 630 can be collected by the waste ink bottle 51.

(Ink Initial Filling)

In the ink jet printer 1 configured as described above, first filling of the ink in the ink supply path and the recording heads 102 is carried out as follows.

First, the ink bottle 900 in which the ink is sufficiently filled is attached to the ink supply path 200. As a result, the ink bottle 900 communicates with the ink supply path 200. Therefore, the ink in the ink bottle 900 flows into the ink tube 205 from the outlet member 901 of the ink bottle 900 by its own weight. At this time, the electromagnetic valve 218 is closed. Therefore, the ink in the ink bottle 900 can not flow into the ink supply path beyond the electromagnetic valve 218. At this time, the ink in the ink bottle 900 fills the ink bottle residual quantity detection sensor portion 250. If the attached ink bottle 900 is empty, the ink tank 251 is not filled with a sufficient quantity of ink. At this time, the ink bottle residual quantity detection sensor 253 outputs a signal for indicating insufficiency of the ink quantity in the ink tank 251 to the control circuit CPU 750. Upon receiving this output, the control circuit CPU 750 makes the display panel 703 display "an error".

When the sufficient quantity of ink is filled in the ink tank 251, an ink initial filling switch on the operation panel 701 is pressed, thereby starting an ink initial filling sequence.

At first, the drive mechanism 106 is driven, and the common recording head unit holder 105 is moved up. As a result, the space between the recording portion 100 and the carriage portion 400 is expanded. Then, immediately after completion of upward movement of the recording head unit holder 105, the catch pan 630 is inserted into the space so as to face the nozzle surface of each recording head 102. When the catch pan 630 reaches a predetermined position (a position facing the recording portion 100), the sensor of the catch pan 630 transmits a signal for indicating this fact to the control circuit CPU 750.

Upon detecting the signal, the control circuit CPU 750 opens the electromagnetic valve 218, and allows supply of the ink from the ink bottle 900. The ink in the ink bottle 900 reaches the tube ink tube branching portion 214 through the ink bottle residual quantity detection sensor 253 and the electromagnetic valve 218. Then, the ink flows toward each of the ink pack 223 side and the ink pool 220 side.

Even if a small quantity of the ink flows into the ink pool 220, the ink does not immediately flow into each head element 104. That is because foreign particle removal filters 110 having a large flow path resistance and the ink tubes 107 are interposed between the ink pool 220 and each head element 104. Before a predetermined quantity of ink is filled in the ink pool 220, the ink does flow toward each head element 104 through the filters 110 and the ink tubes 107. Further, when the predetermined quantity of ink is filled in the ink pool 220, the ink gradually passes through the filters, and the ink flow paths of each head element 104 can be filled with the ink.

If air or air bubbles are mixed in the ink pack 223 or the common ink pool 220, the air or air bubbles move upward in the vertical direction due to a difference in the specific gravity between the air or air bubbles and the ink. The ink supply path 200 according to this embodiment has some structures which facilitate upward movement of air or air bubbles. As one structure, the trifurcate ink tube 213 and the ink tube 205 are arranged so as to be constantly directed upward in the vertical direction between the ink pack 223 and the ink bottle 900, and between the ink pool 220 and the ink bottle 900. As another structure, the flow path resistance is reduced by inclining the ceiling 221 of the ink pool 220. Further, the ink from the ink bottle can rapidly reach the filters 110 by widening the ink path on the upstream ink bottle 900 side of the filters 110. Therefore, air or air bubbles can readily move up to the ink bottle 900. Therefore, the ink moves downward in the vertical direction, whereas air or air bubbles moves upward in the vertical direction and is discharged into the ink bottle 900.

On the contrary, in regard to the ink paths from the filters 110 to the nozzles of the head elements 104, the ink tubes 107 each having a narrow inner diameter are connected to the recording head 102 side or downstream side of the filters 110. Therefore, the ink gradually permeates through the filters 110 and flows toward the head element 104 side from the filters 110 by the capillary force of the tubes and the surface tension of the ink. As a result, the head elements 104 are filled with the ink, and air or air bubbles mixed in the ink paths from the filters 110 to the nozzles of the head elements 104 are pushed and discharged from the nozzles by the ink filled into the head elements.

As a result, the ink can be filled in the ink path portion between the ink pack 223 and the ink tube branching portion 214, in the ink path portion between the common ink pool 220 and the ink tube branching portion 214, and in the ink path portions in the head elements 104 without using an ink supply pump or an ink suction cap. Furthermore, air or air bubbles mixed in the ink path portion between the ink pack 223 and the ink tube branching portion 214, in the ink path portion between the common ink pool 220 and the ink tube branching portion 214, and in the ink path portions in the head elements 104 can be removed.

Furthermore, when air or air bubbles are discharged from the nozzles, the ink may be also discharged in some cases. However, the ink drops which fall from the nozzle surface can be received by the catch pan 630 arranged so as to face the nozzle surface. Therefore, the ink jet printer 1 according to this embodiment can prevent the carriage portion 400 and its periphery from being contaminated with ink.

When the ink is sufficiently filled in the ink path portion between the ink tube branching portion 214 and the ink pack 223, in the ink path portion between the ink tube branching portion 214 and the ink pool 220, and in the ink path portions from the filters 110 to the head elements 104, the electromagnetic valve 218 is closed, and supply of the ink from the ink bottle 900 is stopped.

In regard to the control of stop of the ink supply, a time from the opening of the electromagnetic valve 218 is counted, and the electromagnetic valve 218 is closed when the counted time reaches an ink initial filling time from the opening of the electromagnetic valve 218 until the ink is sufficiently filled in each ink path portions. This ink initial filling time is stored in the memory in advance, and counted by the counter. In this embodiment, the ink initial filling time is set in such a manner that an ink quantity filled in the ink pack 223 reaches, e.g., 100% of the ink capacity of the ink pack 223. Specifically, the ink pack 223 is fully filled with the ink immediately after the electromagnetic valve 218 is closed. As a result, an outer film of the ink pack 223 extends and the ink pack is in an expanded state beyond a stipulated value. After the electromagnetic valve 218 is closed, an effect of contraction (a restoring force) acts on the expanded outer film of the ink pack 223. A pressure (a positive pressure) generated here is transmitted to the ink pool 220, so that the ink can be also supplied to the ink path portion having the high flow resistance beyond the ink pool 220. Therefore, the ink filling time is so set that the ink is filled to approximately 90% or above of the ink capacity and the positive pressure is generated. In the ink pack residual quantity detection sensor portion 225, the first detection level is so set that it indicates that the ink is filled to 80% of the ink capacity with which the positive pressure cannot be assurely applied to the ink in the ink pack 223 by the ink pack.

When the initial filling of the ink is completed, the electromagnetic valve 218 is closed, and the positive pressure is applied to the head elements 104 as described above, an excellent meniscus is not formed in the ink in each nozzle. Thus, after completion of the initial filling of the ink, a time is needed for becoming the restoring force of the ink pack zero. When this restoring force becomes substantially zero, the meniscus is formed in the ink in each nozzle of each head element 104, so that each head element is set in a state in which it can start recording of an image.

Figure 5:
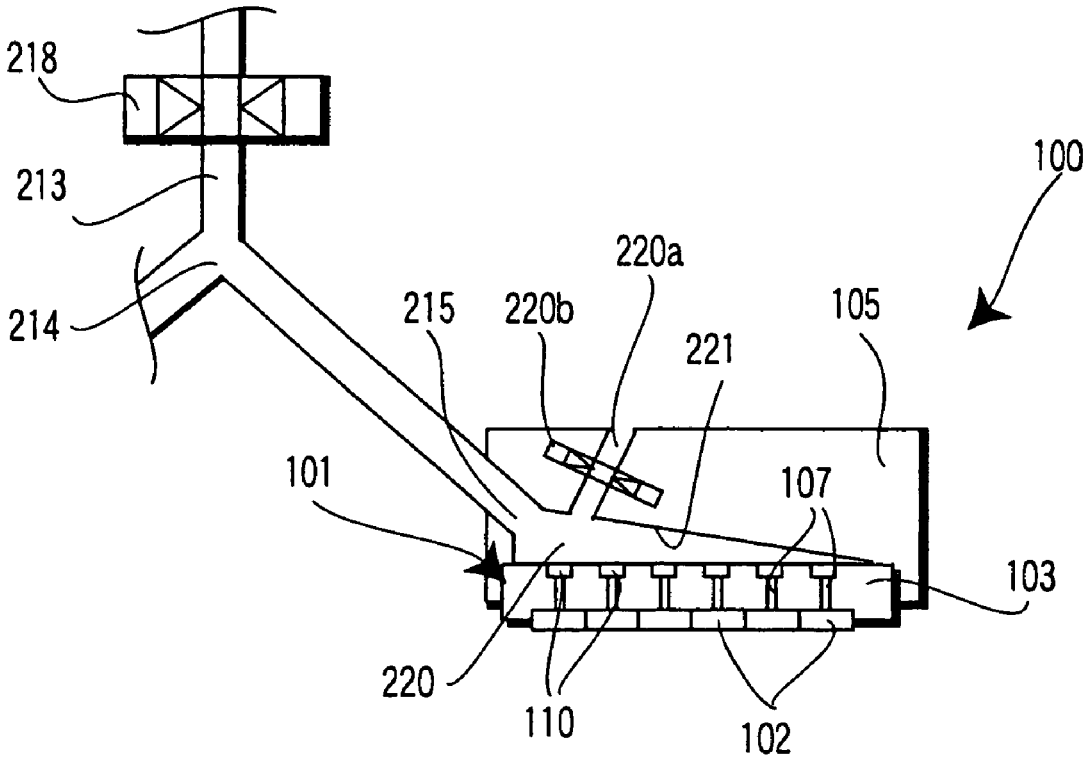
FIG. 5 is a view showing an ink supply path having a vent.

In the ink jet printer 1 according to this embodiment, a vent 220*a* can be provided in the ink pool 220 as shown in FIG. 5 in order to further reduce the ink filling time. This vent 220*a* has one end connected with the ink pool 220 and the other end opened to the outside. Moreover, this vent 220*a* has a valve 220*b* for opening and closing the valve. A method for filling the ink in the case that the vent 220*b* is provided will now be described later.

In the above-described structure, the ink filling time can be further shortened by driving the solenoid 229 after the ink is filled in the ink pack 223 and the electromagnetic valve 218 is closed.

When the solenoid 229 is driven so as to push the ink pack 223 with the electromagnetic valve 218 being closed, the ink is discharged with great force from the pushed ink pack 223 and is supplied into the ink pool 220 through the tube ink tube branching portion 214. Air which is entered into the ink pool is discharged from the vent 220*a*. Therefore, the ink jet printer 1 having the vent 220*a* can rapidly supply the ink into the ink pool 220 without supplying air which can cause a pressure loss into the filters 110 and the head elements 104. The valve 220*b* is closed after the ink is sufficiently supplied into the ink pool 220.

Just after the ink initial filling is completed and the electromagnetic valve 218 is closed, a positive pressure is applied to the head elements 104 as described above and hence the excellent meniscus is not formed in the ink in each nozzle of each head element. Therefore, even if the ink initial filling is completed, recording of an image cannot be started unless the time elapse for the restoring force of the ink pack becomes zero.

However, the capacity of the ink pack 223 can be instantaneously contracted with forcibly pushing the expanded ink pack 223*a* by the solenoid 229 immediately after the completion of the ink initial filling. Specifically, the solenoid 229 extends its arm and pushes ink pack 223 until the ink quantity in the ink pack 223 becomes 80% of the ink capacity, while the valve 220*b* is closed. Then, the solenoid 229 retracts the arm after the ink quantity becomes approximately 80% of the ink capacity. As a result, the ink quantity in the ink pack can be instantaneously set to the vicinity of 80% of the ink capacity. Therefore, a pressure applied to the ink path portions in the head elements 104 can be instantaneously changed from the positive pressure to the negative pressure, thereby shortening the time needed for the start of image recording.

Additionally, the ink path portion between the electromagnetic valve 218 and the ink pack 223 is a sealed space in which the ink is filled. In this state, even if the ink pack 223 pushed by the solenoid 229 supplies the ink toward the recording heads 102, air or air bubbles is not newly supplied to the recording heads 102.

The catch pan 630 is arranged above the carriage portion 400 until a predetermined time elapses after the electromagnetic valve 218 is closed or until a predetermined time elapses after the driving of the solenoid 229 is completed in the case that the solenoid 229 is driven, and then the catch pan 630 is moved from the position above the carriage portion 400.

After the movement of the catch pan 630 is completed, the recording head unit holder 105 is moved down so that each recording head 102 is set in the recordable position. The movement of the catch pan 630 will be described in detail later.

(Ink Supply)

Figure 6:
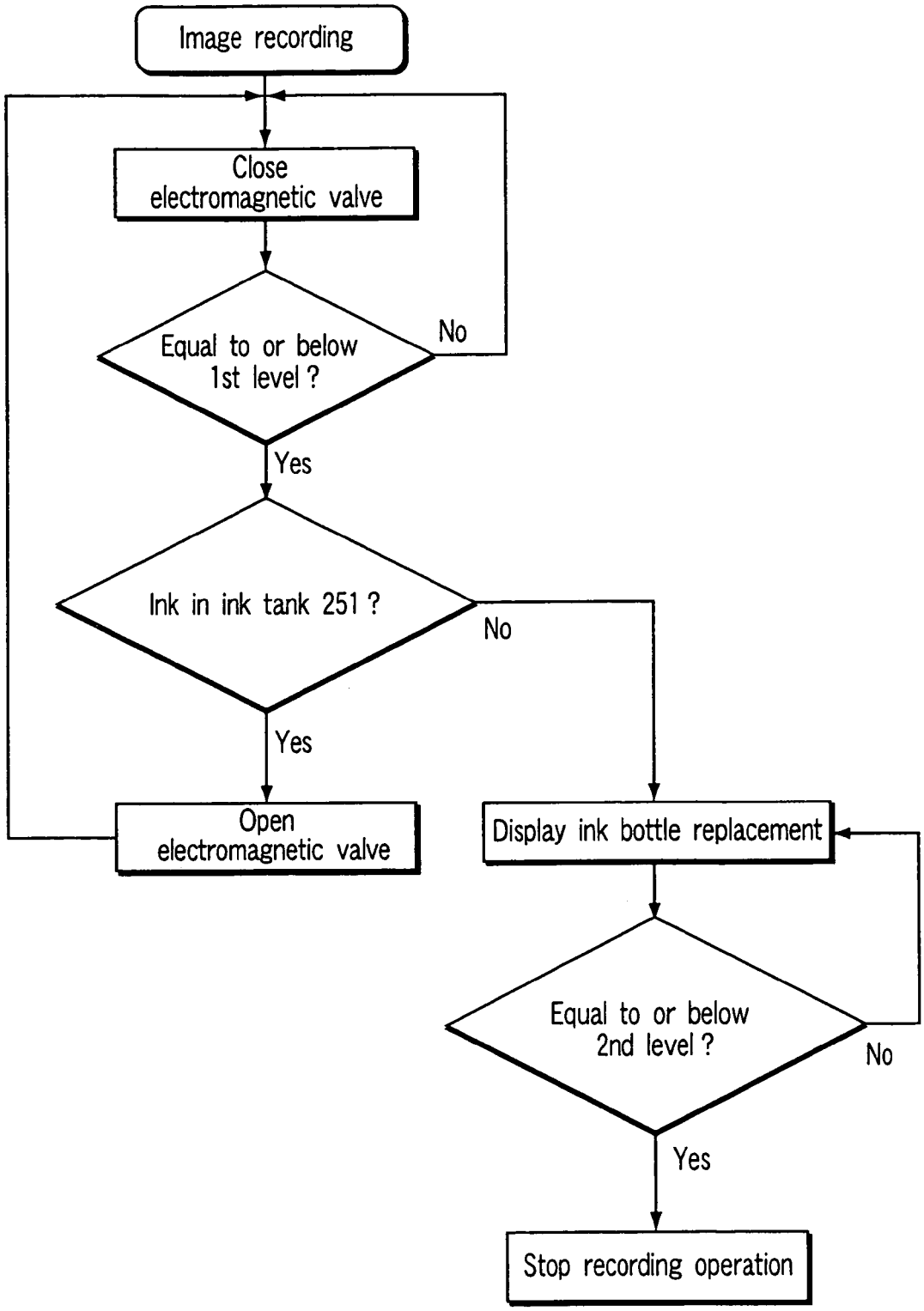
FIG. 6 is a flowchart showing a series of operations concerning ink supply during recording an image.

FIG. 6 shows a series of operations concerning an ink supply during an image is recorded. Usually, during an image is recorded, the electromagnetic valve 218 is closed, the ink is not supplied from the ink bottle 900, and the ink in the ink pack 223 is supplied toward the recording portion 100. Therefore, as the recording of an image continues, the ink in the ink pack 223 is reduced and the ink pack 223 is gradually deflated.

Figure 7:
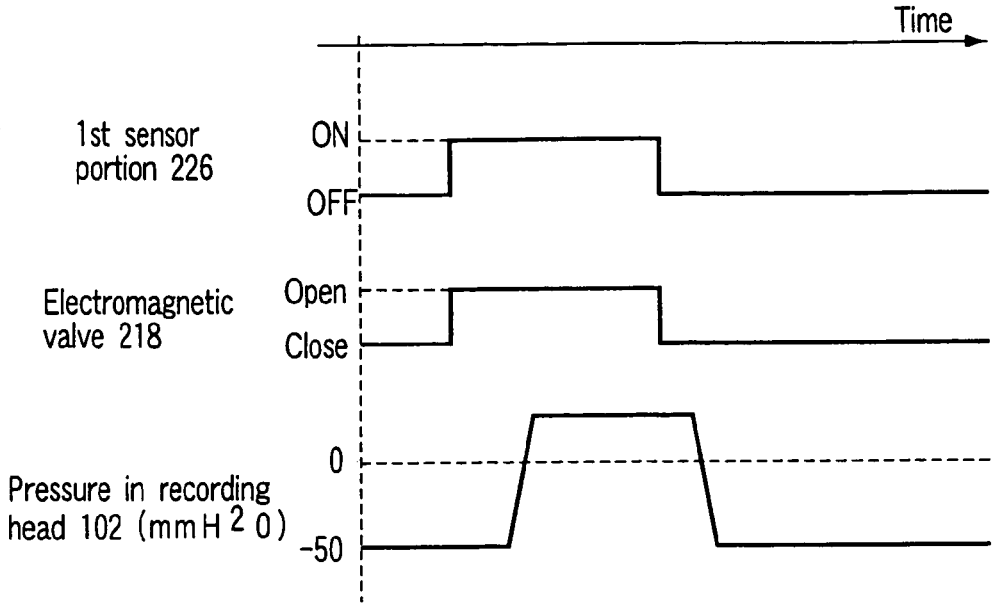
FIG. 7 is a time chart showing a change in pressure in a recording head when an electromagnetic valve is continuously opened.

When the first level sensor 226 of the ink pack residual quantity detection sensor portion 225 detects the first detection level (the ink quantity in the ink pack becomes 80% of the ink capacity) from the deflated state of the ink pack, it transmits a signal for indicating this fact (an ON signal) to the control circuit CPU as shown in FIG. 7.

Upon receiving this signal, the control circuit CPU 750 confirms a detection result (existing of the ink in the ink bottle) of the ink bottle residual quantity detection sensor portion 250, then controls the electromagnetic valve 218 to make it open, and allows supply of the ink from the ink bottle 900. Opening of this electromagnetic valve 218 continues until the ink pack residual quantity detection sensor portion 225 (226) detects that the first detection level is achieved (an OFF signal). As a result, the ink pack 223 is filled with the ink again.

When the detection output from the ink bottle residual quantity detection sensor portion 250 indicates that no ink exist in the bottle even though the ON signal for indicating that the first detection level is achieved is outputted from the ink pack residual quantity detection sensor portion 225 (226), the electromagnetic valve 218 is not opened. This is because air may be possibly supplied. In this case, the display panel 703 of the ink jet printer 1 is operated to display a warning for an advice to replace the empty ink bottle 900 with a new one, then the recording of an image is continued.

When a signal for indicating that the second detection level is achieved is outputted from the second level sensor 227 of the ink pack residual quantity detection sensor portion 225 as a result of continuing the recording of an image and consuming the ink in the ink pack 223, the control circuit CPU 750 determines that there is no ink in the ink bottle 900 and the ink pack 223, forcibly stops the recording of an image or forcibly stops the recording of an image after the currently continued image recording is finished, and controls so as not to record an image even if it receives a next image recording command.

With such an ink supply method, the ink can be supplied to the ink pack 223 from the ink bottle 900 merely by opening the electromagnetic valve 218, and an ink supply pump or an ink suction cap which has been conventionally required can be eliminated. Further, there is an advantage that the ink supply time can be reduced by controlling an opening time of the electromagnetic valve 218.

For the ink supply method which is carried out during the recording of an image, it is preferable to improve the following point. That is, when the electromagnetic valve 218 is continuously opened for a long time, a large quantity of ink is supplied from the ink bottle 900 at a blast, and a sudden pressure change is generated in the ink supply path and the recording portion. Therefore, a negative pressure state maintained during the image recording is suddenly changed to a positive pressure state (see FIG. 7) in the ink path portion between the head elements 104 and the ink pack 223, and an inconvenience that the excellent meniscus formed in each nozzle is destroyed occurs. If such an ink supply is performed during the recording of an image, the excellent ink ejection cannot be performed or the ink falls from the nozzles as soon as the ink path portion in the vicinity of the nozzles changes to the positive pressure state or a pressure state close to it, thereby disabling a high-quality image recording.

In view of the above-described problem, it is preferable to control the electromagnetic valve 218 whose opening degree can be adjusted to be instantaneously opened and closed when the ink is supplied during the recording of an image.

Figure 8:
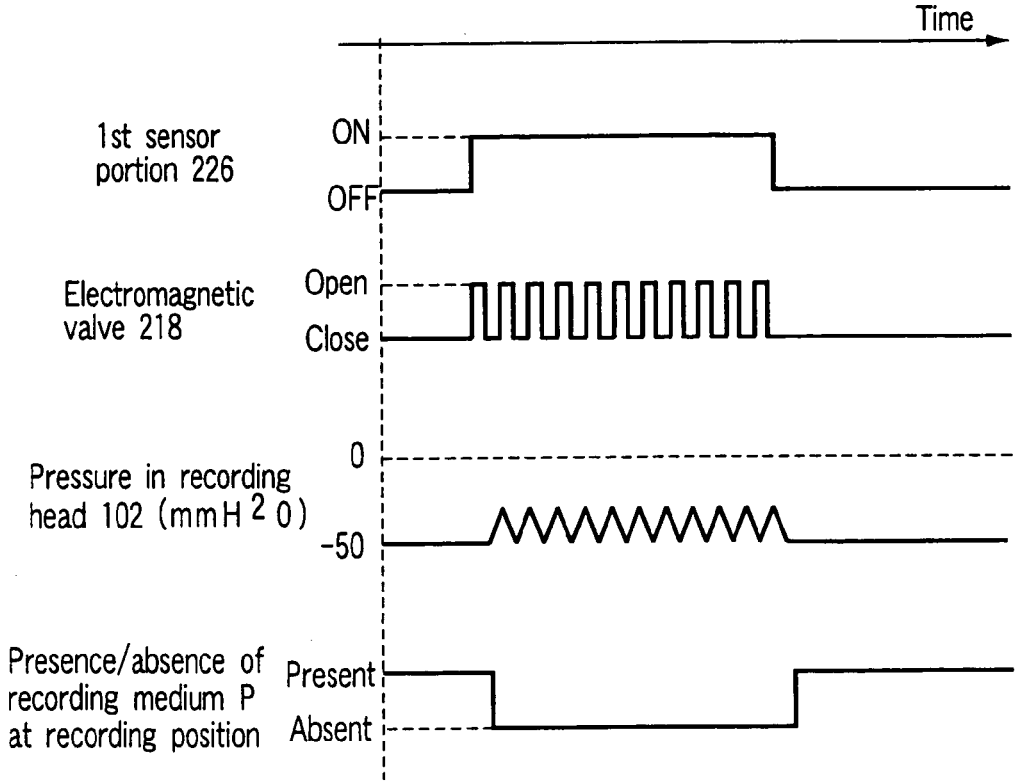
FIG. 8 is a time chart showing a change in pressure in the recording head when the electromagnetic valve is opened/closed in a short cycle.

A preferable ink supply method during the recording of an image will now be described hereinafter with reference to FIG. 8.

Upon receiving the ON signal from the ink pack residual quantity detection sensor portion 225 (226) during the recording of an image, the control circuit CPU 750 opens the electromagnetic valve 218 only for a moment, and then soon closes it. In other words, the electromagnetic valve 218 is intermittently opened. At this time, the opening degree of the electromagnetic valve 218 is adjusted in such a manner that the electromagnetic valve 218 is not opened to its maximum degree. In other words, the electromagnetic valve 218 is opened with an opening degree smaller than the maximum opening degree. Therefore, a flow rate of the ink flowing through the electromagnetic valve 218 is smaller than the maximum flow rate of the ink in the electromagnetic valve. This operation is continued until the ink pack residual quantity detection sensor portion 225 detects that the ink pack 223 is expanded beyond the first detection level.

As described above, by adjusting the opening degree of the electromagnetic valve 218 and by intermittently opening it, the ink does not flow from the ink bottle 900 at a blast, and the pressure in the ink path portion on the downstream side of the electromagnetic valve 218 to the positive pressure state can be prevented from being suddenly changed to the positive pressure state. Furthermore, since the electromagnetic valve 218 is intermittently opened, the flow rate of the ink is small. Thus, the pressure change in the ink path is much less as compared with the case in which the electromagnetic valve 218 is opened for a long time, and the positive pressure, which would destroy the meniscus in the ink in each nozzle, does not act on the ink in each nozzle even if the opening/closing operation of the electromagnetic valve 218 is repeated for a plurality of times.

Although it takes a certain time until the change in pressure from the negative pressure to the positive pressure in the ink path portion in the vicinity of the electromagnetic valve 218 at the moment when the electromagnetic valve 218 is opened is transmitted to the ink pack 223 or to each head element 104, the change in pressure occurs within a negative pressure range and does not affect the ink ejection, and hence it does not change to a positive pressure.

Further, a flexible ink reservoir which functions as an ink buffer may be provided on the lower side of the electromagnetic valve 218.

Although a positive pressure does not act on the ink in each nozzle, it can be considered that the pressure acting on the ink in each nozzle may diversely affect the ink ejection. In view of this case, in this embodiment in which the plurality of cut sheet type recording mediums P are continuously carried with a constant gap (pD, see FIG. 1) therebetween in the carriage portion 400 when the recording of an image is performed, the ink supply is performed so as to match a period in which the pressure applied on the ink in the vicinity of each nozzle is increased by the opening and closing of the electromagnetic valve 218 with a period in which the gap between the two continuously carried recording mediums P is carried in the recording area (see FIG. 8).

In particular, it is preferable that matching the period in which the pressure applied on the ink in the vicinity of each nozzle is increased by the opening and closing of the electromagnetic valve 218 with a period in which the gap between the two continuously carried recording mediums P is carried at a position facing the recording head unit to which ink is supplied in the recording area, in order to shorten the gap between the two continuously carried recording mediums.

With such a structure, even if the ink supply may adversely affect the ink ejection, the gap between the two continuously carried recording mediums P reaches the recording area on the carriage portion 400 when the ink ejection are adversely affected by the ink supply, so that the recording of an image is not performed.

Furthermore, there is a case that recovery from the positive pressure to the negative pressure is weak due to a structure and material of the ink supply path 200. In case of such an ink supply path, since the ink is discontinuously but gradually supplied, a pressure in the vicinity of each nozzle of the head is gradually increased (see FIG. 9). In this case, while the opening/closing operation of the electromagnetic valve 218 is continuously carried out over a period in which the ON signal is received from the ink pack residual quantity detection sensor portion 225, a positive pressure will be applied on the ink in each nozzle.

Figure 9:
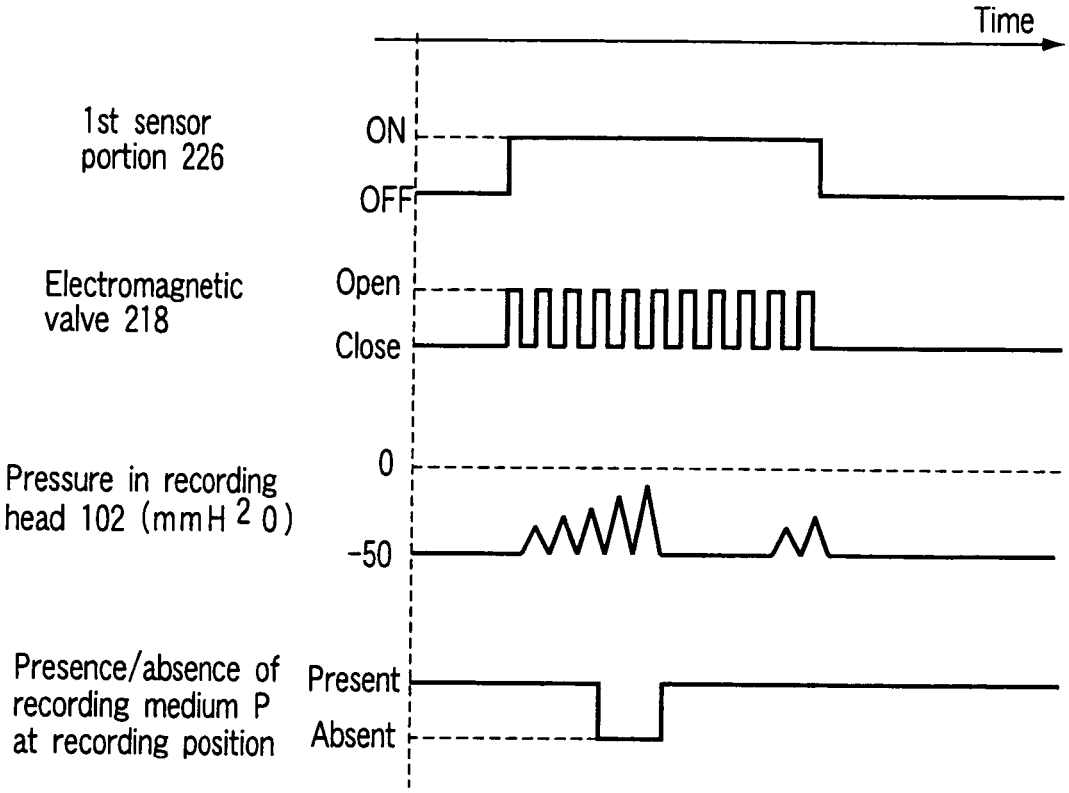
FIG. 9 is a time chart showing a change in pressure in the recording head when the electromagnetic valve is opened/closed in a short cycle only for a predetermined period.

Taking such a case into consideration, in the embodiment in FIG. 9, the continuous opening/closing operation of the electromagnetic valve 218 is performed for five times per one cycle. And, when the five opening/closing operations are terminated, the electromagnetic valve 218 is closed and is held in the closed state for a predetermined time (corresponding to four opening/closing operations in this embodiment) even if the ON signal is received from the ink pack residual quantity detection sensor portion 225.

That is, by stopping four opening/closing operations as indicated by a broken line in FIG. 9 and then performing five continuous opening/closing operations (two operations in this embodiment because of output of the ON signal of the first level sensor), a positive pressure is not applied on the ink in each nozzle, and a pressure change stays in a negative pressure range which does not adversely affect the ink ejection. Furthermore, by stopping opening of the electromagnetic valve 218 only for a predetermined time, the pressure in the ink supply path is averaged. And, when the pressure in the ink supply path returns to an ideal negative pressure state (−50 $mmH^2O$ (approximately −5 hPa) in this embodiment), the next continuous opening/closing operations of the electromagnetic valve 218 is performed to allow the sufficient ink supply.

With this configuration, a sudden pressure change which acts on the ink in the ink supply path portion in the vicinity of each nozzle can be suppressed, and the pressure can be prevented from being changed to a positive pressure, so that the ink can be supplied in the ink path even during recording of an image while the ink is constantly maintains a negative pressure.

It is to be noted that the opening degree of the electromagnetic valve 218 is adjusted so as not to be maximum at the time of opening in this embodiment.

(Replacement of Ink Bottle)

A replacement of the ink Bottle will now be described.

A fact that the ink residual quantity in the ink bottle 900 becomes zero can be detected by the ink bottle residual quantity detection sensor portion 250. Based on a detection output from this ink bottle residual quantity detection sensor portion 250, the control circuit CPU 750 makes the display panel 703 display information for indicating that the ink bottle must be replaced or the like or makes the speaker 702 generate a warning sound, thereby indicating an operator to replace the ink bottle 900 quickly.

However, when the ink quantity in the ink bottle 900 becomes zero while a sufficient quantity of ink is held in the ink tank 251 of the ink bottle residual quantity detection sensor portion 250 and the ink bottle residual quantity detection sensor 253 does not detect lack of the ink, the control circuit CPU 750 recognizes that the ink still remains in the ink bottle 900.

In such a situation, when the control circuit CPU receives the signal, which indicates that the ink quantity in the ink pack reaches the first detection level, from the ink pack residual quantity detection sensor 225, the control circuit CPU opens the electromagnetic valve 218 in order to supply the ink to the ink pack 223. At this time, there is a possibility that all of the ink in the ink tank 251 of the ink bottle residual quantity detection sensor portion 250 may flow toward the electromagnetic valve 218. In this case, although a signal for indicating a lack of the ink is transmitted from the ink bottle residual quantity detection sensor portion 250 and the electromagnetic valve 218 is closed in response to this signal, air may be also supplied. After the empty ink bottle 900 is replaced with new one the ink supply from the new one starts, the air supplied into the ink path is naturally moved toward the new ink bottle 900 and is discharged from the ink path. However, air entered into and stayed in the ink path is not preferable in view of maintenance of a water head value in each head element 104. Furthermore, air is supplied into the ink pool 220 side or the ink pack 223 side in the ink path beyond the ink tube branching portion 214. When an ink surface level becomes lower than the tube branching portion 214, air may be possibly supplied to the head elements 104 due to an ink consumption for recording of an image. Therefore, it is preferable that the ink bottle residual quantity detection sensor portion 250 has a sufficient ink tank capacity and an ink quantity corresponding to a detection level for indicating lack of the ink is set to be larger than an ink supply quantity in one opening operation of the electromagnetic valve 218. Moreover, not only the ink bottle residual quantity detection sensor 250 is so improved as described above, but also an inner diameter of the ink tube 205 between the ink bottle residual quantity detection sensor portion 250 and the electromagnetic valve 218 and a length thereof may be increased.

In any case, the ink path portion above the electromagnetic valve 218 is configured in such a manner that an ink quantity which is supplied for one opening operation of the electromagnetic valve 218 can be assured by the ink path portion above the electromagnetic valve 218 and the ink liquid level does not reach the ink path portion lower than the ink tube branching portion 214 or, preferably, the ink surface level stays above the electromagnetic valve 218.

Figure 10:
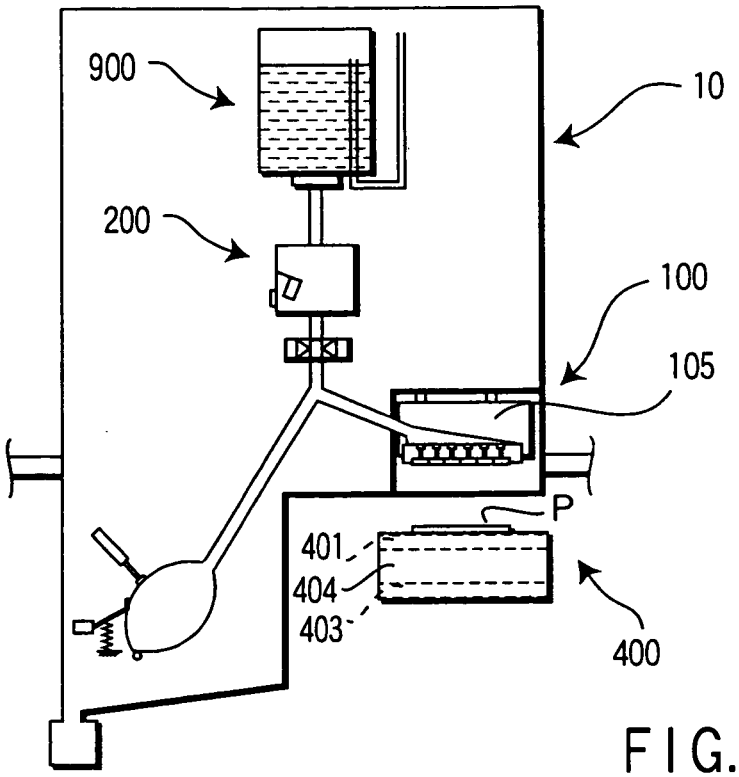
FIG. 10 is a side view when a recording head unit holder is moved up.
Figure 11:
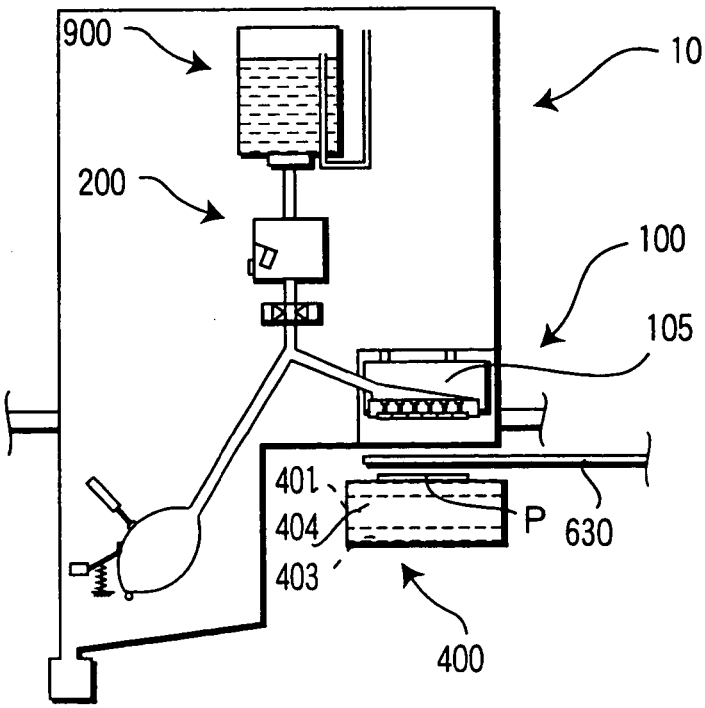
FIG. 11 is a side view when a catch pan is inserted.

In order to replace the ink bottle 900 with a new one, at first the recording head unit holder 105 is moved up as in the case of the ink initial filling (see FIG. 10). Then, the catch pan 630 is inserted into the expanded gap between each recording head unit 101 and the carriage portion 400 (see FIG. 11). As a result, when the electromagnetic valve 218 is opened in order to supply the ink after the replacement of the ink bottle 900, the inside of the apparatus can be prevented from being contaminated with ink even if the pressure of the ink in the ink path becomes a positive pressure due to a pressure change. In the ink supply after the replacement of the ink bottle 900, since the head elements 104 have been already filled with ink, the control circuit CPU 750 controls the electromagnetic valve 218 to be closed when the control circuit receives a signal for indicating that the ink reaches the first detection level from the ink pack residual quantity detection sensor portion 225 (226).

The control circuit CPU 750 controls the insertion and removal of the catch pan 630 depending on a detection output for detecting the attachment and detachment of the ink bottle 900 from a sensor (not shown) and a position of the recording head unit holder 105 in the vertical direction. In particular, it is preferable to control the catch pan 630 to be automatically inserted into the space between each recording head unit 101 and the carriage portion 400 when it is detected that the ink bottle 900 is removed and the recording head unit holder 105 is moved up.

As described above, the catch pan 630 is inserted into the space between each recording head unit 101 and the carriage portion 400 while the initial ink filling is performed or while the replacement of the ink bottle 900 is performed. Further, it is also preferable to perform the insertion of the catch pan 630 while the head element is caused to perform purging (forcible discharge of the ink) or while a replacement of the recording head unit 101 is performed.

The control for insertion of the catch pan 630 may be carried out by a catch pan operation switch provided on the operation panel 701, or the insertion of the catch pan 630 may be set to be automatically performed in an initial filling sequence or in an ink supply sequence, which is started by an operation switch to operate the ink initial filling or the ink supply. Moreover, the insertion of the catch pan 630 may be performed during a power supply off sequence of the ink jet printer 1 and may be continued while the power supply of the ink jet printer 1 is off.

Figure 12:
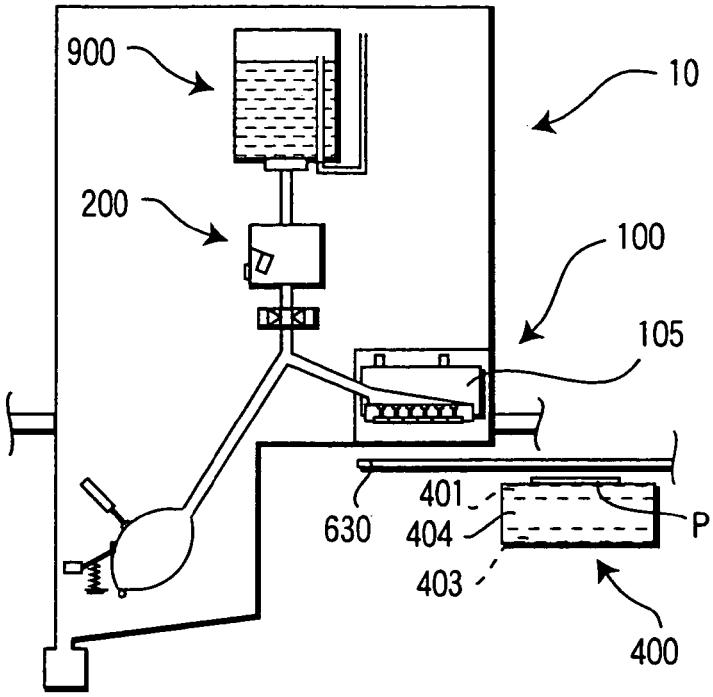
FIG. 12 is a side view when the catch pan is pulled out with the movable body toward an operation side of the ink jet printer.

Additionally, although the catch pan 630 can move between the initial position (a position being away from a position above the carriage portion 400) and the position above the carriage portion 400 in the above description, the movement of the catch pan 630 is not restricted thereto. For example, it may be configured to locate the catch pan 630 below the recording head unit 101 at every time in which the replacement of the recording head unit 101 is performed. More specifically, when the replacement of the recording head unit 101 is performed, the catch pan 630 is inserted in the space between each recording head unit 101 and the carriage portion 400 after the recording head unit holder 105 is moved up. Thereafter, the catch pan 630 is engaged with the movable body 10 when it reaches a predetermined position. Then, the movable body 10 is pulled out toward the front side of the ink jet printer 1 by an operator. At this time, since the catch pan 630 is engaged with the movable body 10, it is pulled out together with the movable body 10 (see FIG. 12). That is, the catch pan 630 is always located below the recording head unit 101, and contaminations caused by ink drops falling from the recording head unit 101 can be avoided.

The retraction of the catch pan 630, e.g., the operation for displacing the catch pan 630 performed after the ink initial filling or the replacement of the ink bottle 900 is finished may be performed when a predetermined time elapses after the closing operation of the electromagnetic valve 218 at the time of initial filling. Alternatively, the catch pan 630 may be retracted when a cleaning sequence of the nozzle surface is finished after the ink initial filling or the replacement of the ink bottle 900.

Although the filter 110 is provided at the opening of the ink tube in the ink pool 220 in this embodiment, the filter 110 may be provided at a position in the ink tube near to the opening thereof in the head element 104. In this case, it is preferable to sufficiently increase the inner diameter of the ink tube 107 between the ink pool 220 and the filter and to sufficiently reduce the inner diameter of the ink path on the downstream side of the filter. That is, an advantage that air in the ink flow path can readily flow toward the ink bottle 900 can be obtained by widening the ink path on the upstream side of the filter and air in the downstream side of the filter can be pushed toward each of the nozzles of the head element 104.

The foreign particle removal filter provided in this embodiment may be eliminated.

All of the recording head units 101 for four colors and the ink supply paths corresponding to the respective units are mounted on the movable body 10. And, the movable body 10 can be pulled out from the ink jet printer 1 along the horizontal guide rail 11. Therefore, when a replacement of, e.g., only one in the four recording head units is performed, the entire movable body 10 is pulled out, and an operator replaces the recording head unit 101 from the upper part of the movable body 10. At this time, since the whole of the movable body 10 is pulled out, the whole of the ink supply path from the ink bottle 900 to each recording head 102 can also be pulled out without changing relative positions of constituent portions to each other. This provides an advantage that the ink supply path 200 does not need to have an excessive length more than necessary, and another advantage that the ink supply path for a color which is not replaced is not disconnected. If all of the recording head units 101 for four colors are configured such that all of them must be displaced away from the ink supply paths corresponding to the respective units when each of the recording head units 101 is displaced for replacement, with each of the ink supply paths, which includes the ink bottle 900 and the ink pack 223, corresponding to the recording head unit 101 to be replaced, being not displaced, the ink tube connected to the recording head unit must have enough length to prevent the ink tube from disconnecting.

In this embodiment, since all of the constituent elements of each ink supply path are mounted on the movable body 10 so as not to change a relative positional relationship between them, each ink supply path is prevented from being disconnected while the replace of the recording head unit corresponding thereto is performed.

Furthermore, in order to apply a negative pressure to the ink in each nozzle of each recording head 102, the nozzle surface of the recording head 102 must be positioned above the paper carriage path, and the ink pack 223 must be positioned below the paper carriage path. In order to achieve such a positional relationship, the ink path portion from the ink tube branching portion 214 to the ink pack 223 is arranged in one side of the paper carriage path (left side in FIG. 2) in the paper widthwise direction. Moreover, the above described side in which the above described ink path portion is arranged is determined as an operation side of the ink jet printer 1 and the movable body 10 is configured to be pulled out toward the operation side, thereby avoiding a collision of the ink supply path 200 with the paper carriage path.

Figure 13:
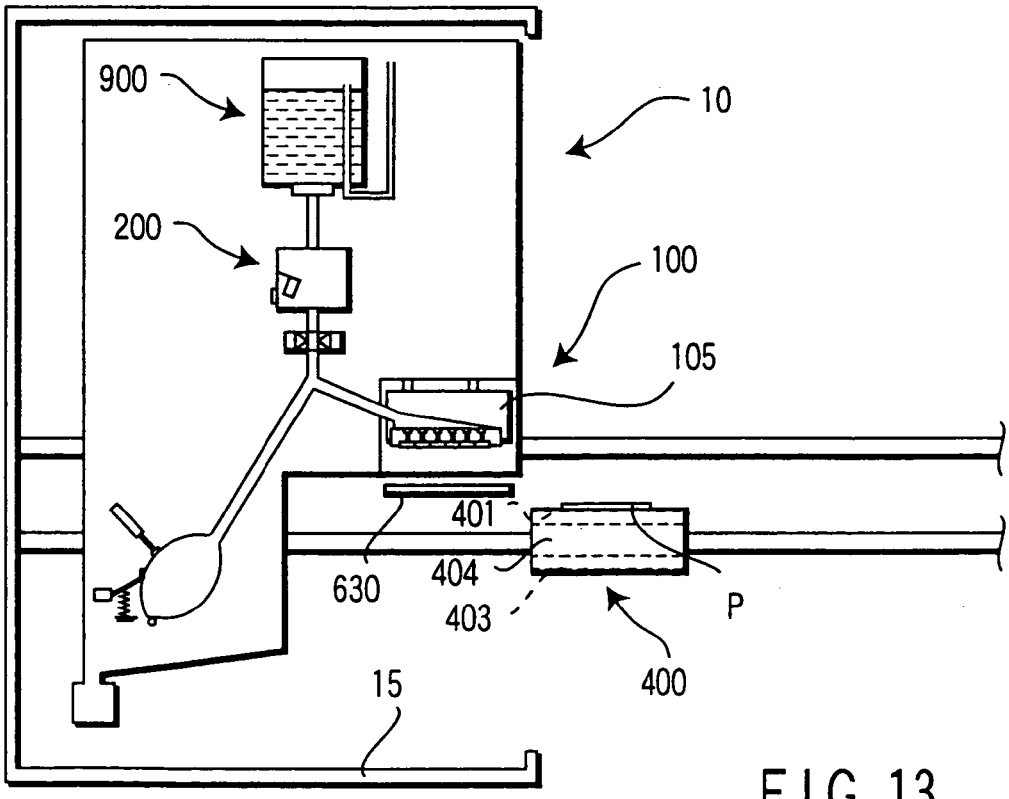
FIG. 13 is a side view of an ink jet printer according to a modification of the first embodiment, and it is a side view when a carriage portion is pulled out toward the operation side of the printer.
Figure 14:
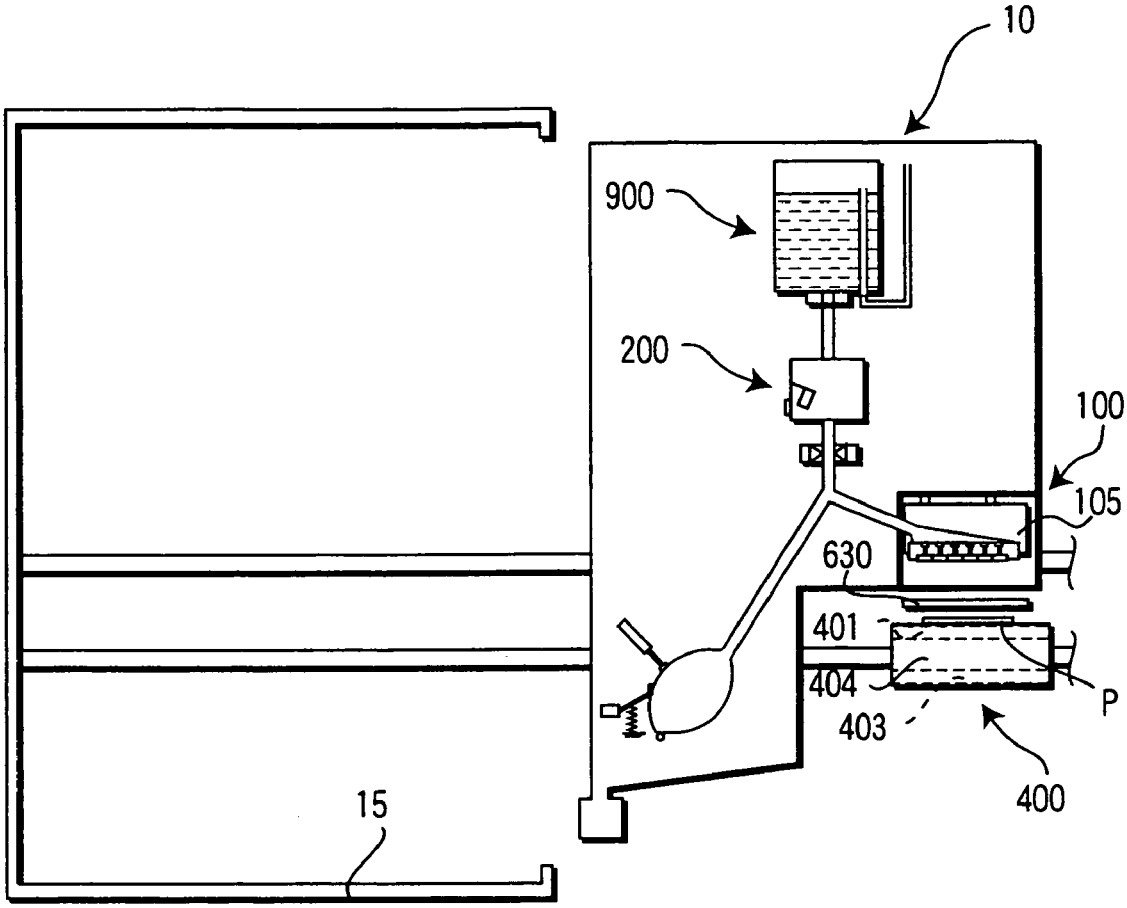
FIG. 14 is a side view when the movable body is pulled out with the carriage portion toward the operation side of the printer.

Alternatively, in another embodiment shown in FIGS. 13 and 14, the ink path portion from the ink tube branching portion 214 to the ink pack 223 is arranged in the other side of the paper carriage path in the paper widthwise direction, which is opposite to an operation side (the operation side in this another embodiment shown in FIGS. 13 and 14 is set as the right side of the paper carriage path in FIGS. 13 and 14). Further, in this another embodiment, not only the movable body 10 but also the carriage portion 400 is configured to be pulled out to the operation side.

The carriage portion 400 can be pulled out to the operation side along the horizontal guide rail 11 from a case 15 of the ink jet printer 1. After the carriage portion 400 is pulled out from the case 15 (see FIG. 13), the movable body 10 is then pulled out along the horizontal guide rail 11 (see FIG. 14).

With such a structure, advantages that access to the constituent elements mounted on the movable body 10 can be facilitated from the operation side and also a process for removing a jam of the recording medium P can be easily performed from the operation side.

SECOND EMBODIMENT

Now, an ink path of an ink jet printer according to a second embodiment will be described hereinafter with reference to the accompanying drawings. The same constituent elements of the ink path of the second embodiment as those of the ink path of the first embodiment are denoted by the same reference numerals as those denoting the same constituent elements of the ink path of the first embodiment, and the detailed explanation as to those constituent elements will be omitted to make the description of the second embodiment ease. Further, only one ink path concerning one ink among a plurality of ink paths used in this embodiment will be described. For example, in a printer which performs color recording by using four or six color inks, the number of ink paths prepared corresponds to the number of types of inks, i.e., four or six, naturally.

The ink jet printer 1 of this embodiment is different from the ink jet printer 1 of the first embodiment in structures on the upstream side of the electromagnetic valve 218. Furthermore, the ink jet printer 1 of this embodiment has a bottle holder 19 for holding the ink bottle 900.

Figure 15:
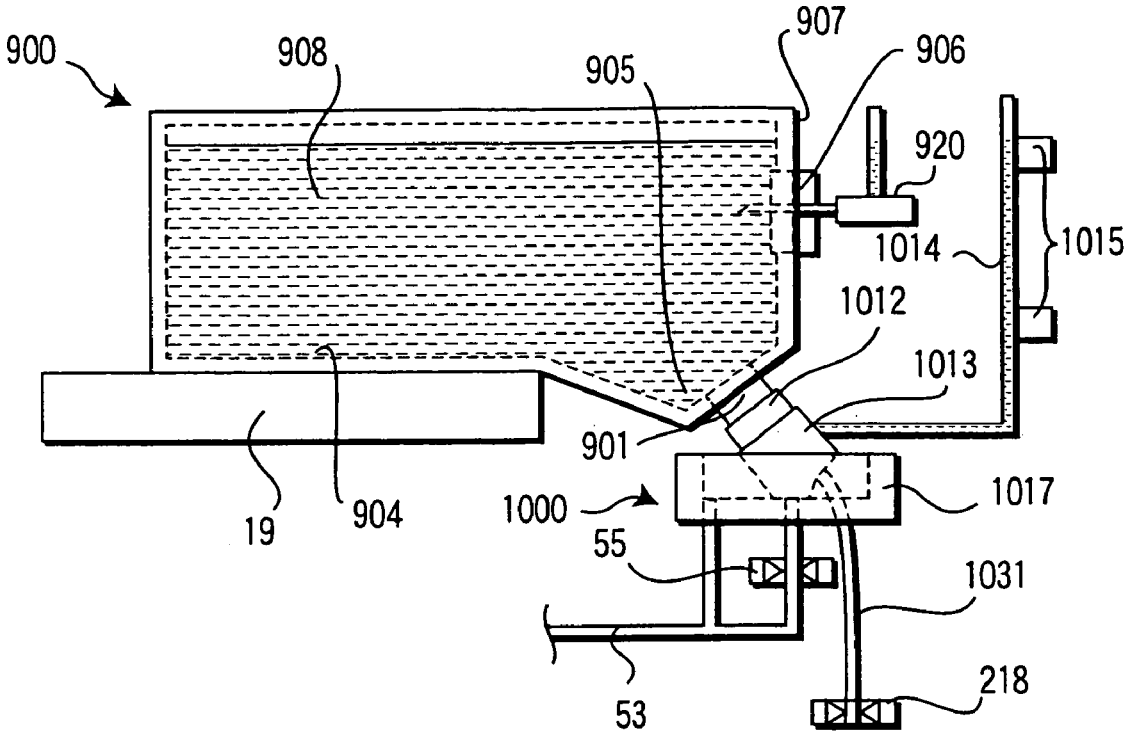
FIG. 15 is a schematic view showing a structure of an ink jet printer in a second embodiment.

FIG. 15 shows the structures on the upstream side of the electromagnetic valve 218 in the ink jet printer of this embodiment.

Figure 16:
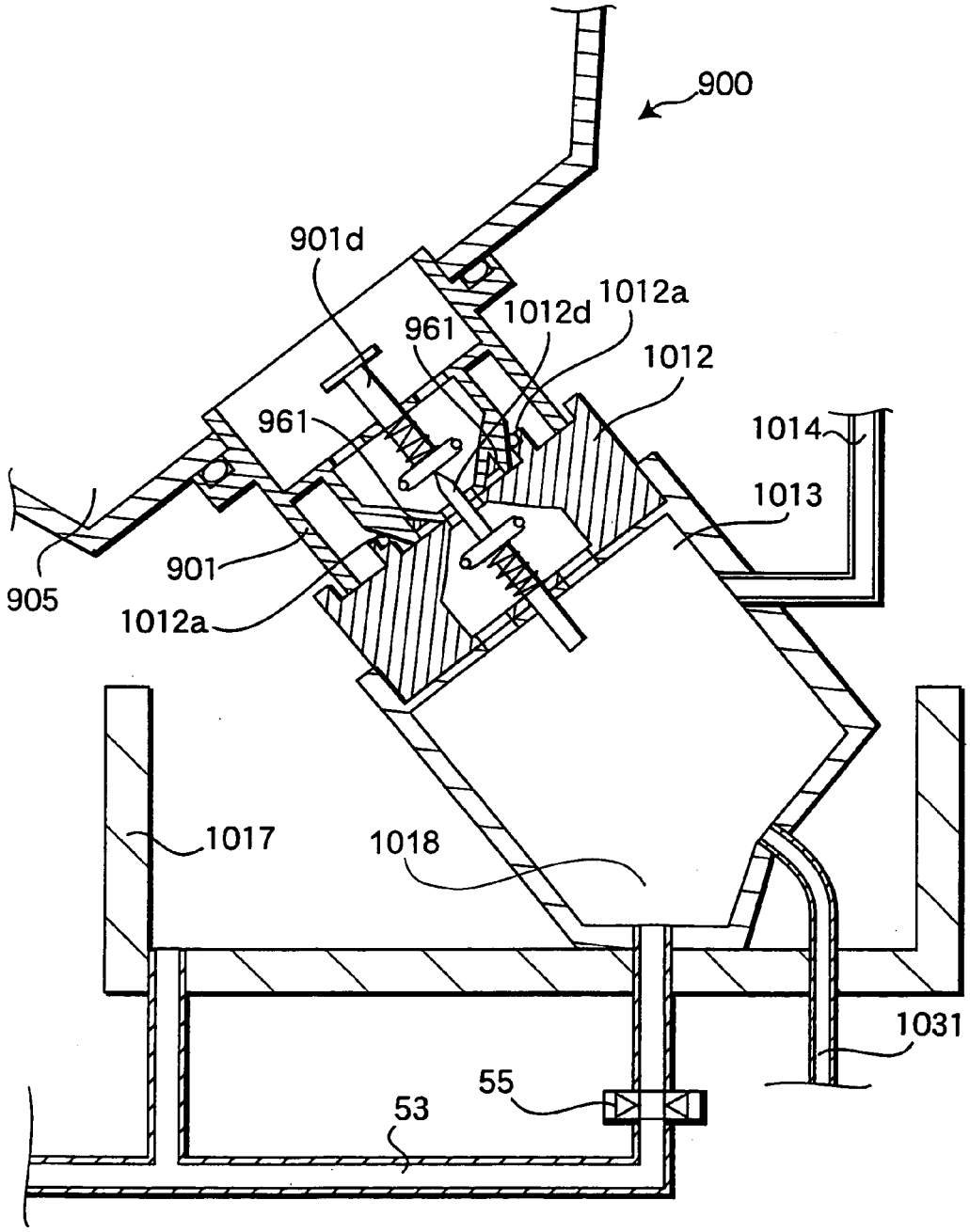
FIG. 16 is an enlarged cross-sectional view showing a connection portion between an ink bottle and an ink bottle residual quantity detection sensor portion in FIG. 15.

As shown in FIG. 16, the ink bottle 900 arranged above the ink path in the vertical direction is configured by a case formed of a material like a plastic case, and a large quantity of ink used for recording is held in an ink holding portion 908 in this bottle. The ink bottle 900 is detachably attached to an ink residual quantity detection sensor portion 1000 for the ink bottle. Therefore, the ink bottle 900 can be attached to and detached from the ink supply path 200. Therefore, when a quantity of ink held in the ink bottle is reduced, the ink bottle 900 can be replaced with a new ink bottle 900.

FIG. 16 is an enlarged cross-sectional view showing a connection portion between the ink bottle 900 and the ink residual quantity detection sensor portion 1000 for the ink bottle.

As shown in FIG. 16, an outlet member 901 which is a valve type ink supply opening is provided to a lower part of the case of the ink bottle 900 so as to be capable of supplying the ink to the recording head side by the own weight of the ink. The outlet member 901 is directed in an obliquely lower direction. The ink held in the ink holding portion 908 is supplied from this outlet member toward the ink path on the printer side.

When this outlet member 901 is coupled with a joint member 1012 of the ink residual quantity detection sensor portion 1000 for the ink bottle, an inside valve 901*d* is opened, and is communicated with the ink path on the printer side. Furthermore, an ink reserve portion 905 is formed in the ink bottle 900 near to the outlet member 901, and the ink reserve portion 905 reserves ink, the viscosity of which becomes high due to a lapse of time or the like and which is not appropriate for recording, in the ink holding portion 908 and prevents the ink of the high viscosity from flowing out from the ink holding portion 908. A main bottom surface 904 of the ink bottle is designed to have a higher level than that of the ink reserve portion 905 in the vertical direction.

Although a substantially whole of the case of the ink bottle 900 is formed of a hard material such as plastic, a hole is formed at an upper part of a front surface 907 (a right end surface in FIG. 16) in a insertion direction toward the bottle holder 19, and a rubber seal 906 is provided so as to cover this hole. A hollow needle 920 for ventilation is inserted into this rubber seal. This rubber seal 906 seals the inside of the ink holding portion 908 before the hollow needle 920 for ventilation is inserted therein, e.g., while the ink bottle 900 is not attached to the ink jet printer 1, but an atmospheric pressure is applied to the inside of the ink holding portion 908 after the hollow needle 920 is inserted therein. The details concerning ventilation will be described later.

In this embodiment, as shown in FIG. 16, the ink residual quantity detection sensor portion 1000 has an ink tank 1013 provided between the joint member 1012 for engaging with the outlet member 901 of the ink bottle 900 and an ink tube 1031 for a supply path which is used to supply ink from the joint member 1012 toward the recording head 102 side, and a sensor portion which is used to detect a residual quantity of ink in the ink bottle 900. This sensor portion comprises a communication tube 1014 for detecting a residual quantity of ink, which communicates with the ink tank 1013 and extends upwards, residual quantity detection sensors 1015 provided on the communication tube 1014, and a communication tube 16 for ventilation, which communicates with the ink tank 1013 and removes air bubbles in the ink tank 1013.

One end of the ink tube 1031 is connected with the ink tank 1013, and the other end of the same is connected with the trifurcate ink tube 213 through the electromagnetic valve 218.

The joint member 1012 has an O-ring portion 1012*a* which is to be in contact with the outlet member 901. The O-ring portion 1012*a* protrudes in an attachment direction in which the joint member 1012 is attached to the outlet member 901.

Moreover, the joint member 1012 has a valve 1012*d* which comes into contact with the valve 901*d* of the outlet member 901 and is opened together with the opening of the valve 901*d* when the joint member 1012 engages with the outlet member 901. A pin is provided at a projected end of the valve 1012*d*, and this pin pushes the valve 901*d* and opens the valve 901*d* when the joint member 1012 engages with the outlet member. Additionally, the pin is also pushed by the valve 901*d* and opens the joint member 1012 while the valve 901*d* is opened.

Further, a waste ink pan 1017, which is formed so as to surround the ink tank 1013 and collects the ink which leaks from the ink bottle 900, and a tube 53 for a waste ink path, which communicates with the waste ink pan 1017 and causes the collected waste ink to flow toward the waste ink bottle 51, are provided to the ink residual quantity detection sensor portion 1000.

The tube 53 is formed into a trifurcate shape, and one end of which is connected with the waste ink bottle 51, one of the two remaining ends is connected with the waste ink pan 1017, and the other one of the same is connected with the ink tank 1013.

When the joint member 1012 is coupled with the outlet member 901 of the ink bottle 900, the valves 901*d* and 1012*d* are opened and opens the ink path. This joint member 1012 is inclined to direct to the inclined outlet member 901 of the ink bottle 900.

As shown in FIG. 16, an ink reserve portion 1018 is formed in the ink tank 1013 so as to be located below the position, at which the ink tube 1031 is connected to the ink tank, in the height direction. The ink, the viscosity and density of which become high due to a lapse of time, is reserved in this ink reserve portion 1018, and the ink reserve portion 1018 prevents the ink reserved therein from being supplied to the ink tube 1031 for the ink supply path as much as possible. Furthermore, the tube 53 for the waste liquid path, which communicates with the waste ink bottle 51, is connected to a bottom portion of the ink reserve portion 1018 so as to process the ink reserved in this ink reserve portion 1018 as a waste liquid. An electromagnetic valve 55 is provided on this waste liquid tube 53. By appropriately opening/closing this electromagnetic valve 55, the ink reserved in the ink reserve portion 1018 can be flowed to the waste ink bottle 51.

Therefore, in this embodiment, although the ink reserve portion 905 which reserves the ink with a high viscosity or density is formed in the ink bottle 900, such ink with a high viscosity or density can be reserved in the ink reserve portion 1018 in this ink tank 1013 even if this ink is not reserved in the ink reserve portion 905 and is supplied to the ink tank 1013 through the outlet member 901, thereby preventing this ink from being supplied to the recording heads 102.

The ink reserve portion 905 does not have to be formed in the ink bottle 900 as long as the ink reserve portion 1018 is formed in the ink tank 1013 in this manner, and all the ink in the ink bottle may be supplied to the ink residual quantity detection sensor portion 1000 by, e.g., swiveling the ink bottle.

(Ink Initial Filling)

Now, an operation for first ink filing to the ink path, excepting the waste liquid path, of the ink jet printer configured as described above will be described in detail.

At first, the ink bottle 900 in which sufficient ink is filled is inserted into the bottle holder 19 of the printer, and the outlet member 901 of the ink bottle 900 is coupled with the joint member 1012 of the ink residual quantity detection sensor portion 1000.

Furthermore, since the ventilation hollow needle 920 is provided on the bottle holder 19 at a position facing the rubber seal 906 of the ink bottle 900, the rubber seal 906 on the front surface 907 of the ink bottle 900 moves toward the hollow needle 920 with the insertion of the ink bottle 900, and the hollow needle 920 is inserted into this rubber seal 906.

Since ventilation is performed when the hollow needle 920 pierces the rubber seal 906, it is preferable that this ventilation is performed after the outlet member 901 of the ink bottle 900 is coupled to the joint member 1012 of the ink residual quantity detection sensor portion 1000, in order to restrict a leak quantity of ink.

When the ink bottle 900 is attached to the bottle holder 19, an electromagnetic valve is opened by a command from a non-illustrated control portion. Therefore, when the ink bottle 900 is inserted into the bottle holder 19, its outlet member 901 is coupled with the joint member 1012, the ventilation is performed, and the ink bottle 900 reaches a predetermined position in the bottle holder 19, the ink flows out from the outlet member 901 by its own weight and the ink is supplied to the ink supply path 200.

Now, a structure of the ink bottle 900 and that of the ink residual quantity detection sensor portion 1000, both of which are for preventing ink leakage at the time of attachment and detachment of the ink bottle 900.

Figure 17:
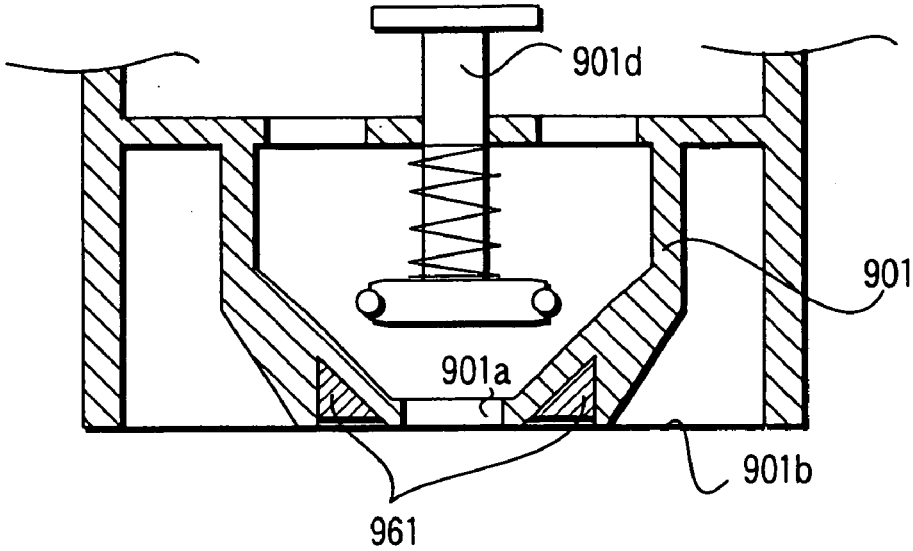
FIG. 17 is an enlarged cross-sectional view showing an outlet member in FIG. 16.

FIG. 17 is an enlarged cross-sectional view showing the vicinity of the outlet member 901 of the ink bottle 900. As shown in this figure, a sponge 961 as an ink absorber is provided in the vicinity of the outlet member 901 as a bottle side joint so as to surround an opening 901*a* of the outlet member 901. Moreover, this sponge 961 is provided at a position set back inwardly from an end edge 901*b* of the outlet member 901.

This sponge 961 absorbs the ink stayed on the outlet member 901 or absorbs the ink adhering to the joint member 1012. By providing the sponge 961 around the outlet member 901 of the ink bottle 900 in this manner, the ink adhering to the outlet member 901 and the vicinity thereof can be absorbed, thereby avoiding contaminations due to a fall of an ink drop.

Additionally, since the sponge 961 is arranged at the position set back from the end edge 901*b* of the outlet member 901, a user can be prevented from accidentally touching the sponge 961.

Figure 18:
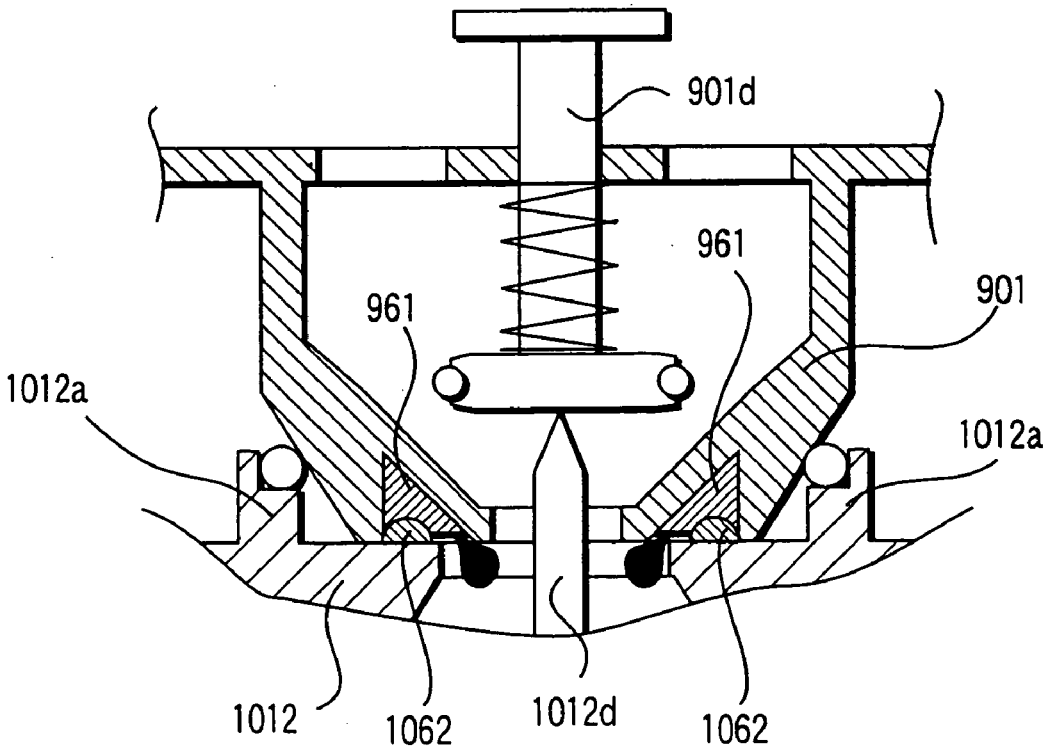
FIG. 18 is a cross-sectional view showing an outlet member which has a protrusion and leads the ink to a joint member 1012, and a joint portion.

Further, as shown in FIG. 18, by forming a protrusion 1062 at a position, which faces the sponge 961, on the joint member 1012, the sponge 961 is pushed and flattened out by the protrusion 1062 when the ink bottle 900 is attached, and the absorbed ink in the sponge can be squeezed out. Furthermore, the squeezed out ink is flowed into the ink tank 1013 through the joint member 1012, thereby reducing the ink which adheres to the vicinity of the outlet member 901 of the ink bottle 900.

Figure 19:
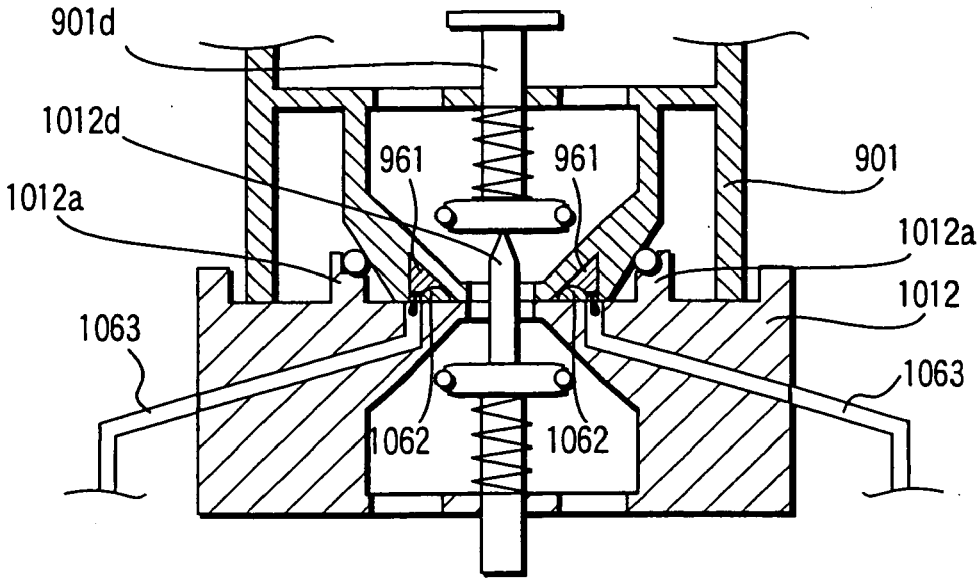
FIG. 19 is a cross-sectional view showing an outlet member which has a protrusion and leads the ink to a waste ink bottle, and a joint portion.

Moreover, as shown in FIG. 19, the ink squeezed out from the sponge 961 can be flowed to the waste ink pan 1017 by forming an ink flow path 1063 communicating with the waste ink pan 1017 to the joint member 1012.

Figure 20:
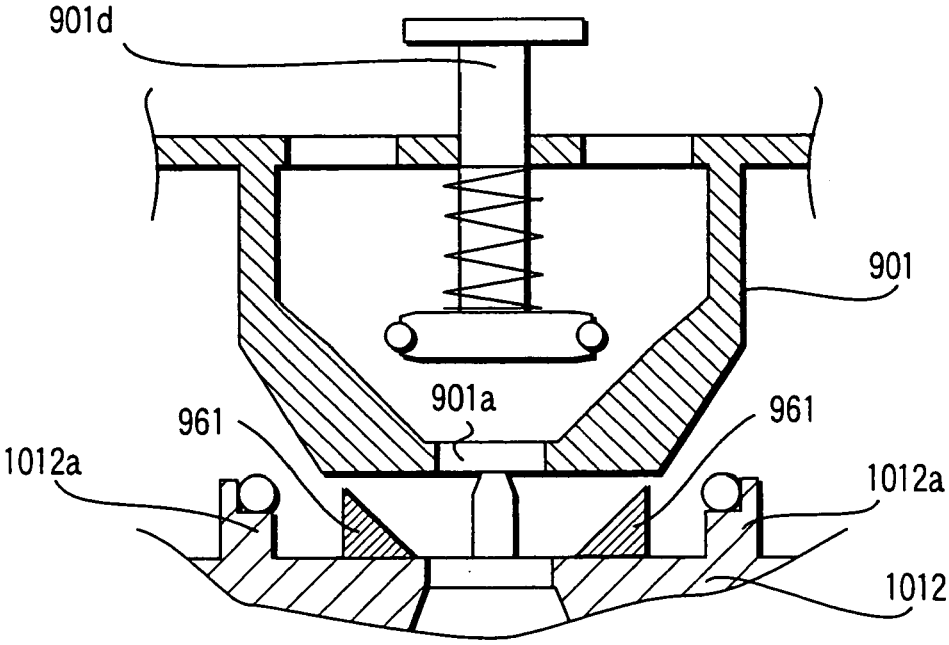
FIG. 20 is a cross-sectional view showing a joint portion having a sponge.

Alternatively, the sponge 961 may be provided on the joint member 1012 as shown in FIG. 20, instead of on the outlet member 901. Since the sponge 961 is surrounded by the O-ring portion, the ink flowed out from the sponge 961 is prevented from contaminating the apparatus.

In the above described ink jet printer 1 according to this embodiment, air from the ink supply path 200 is discharged into the ink bottle 900 from the joint member 1012 through the outlet member 901. But, if flow path resistances for the joint member 1012 and the outlet member 901 are large, the ink jet printer 1 can be configured in the following manner.

Figure 21:
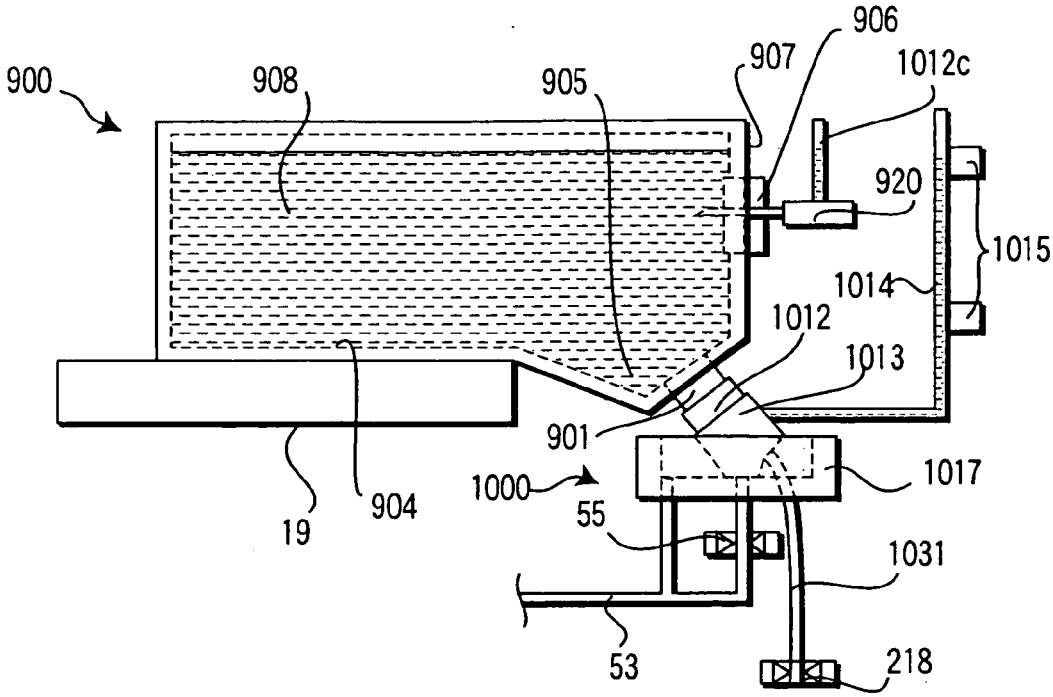
FIG. 21 is a schematic view showing a joint portion having a vent tube.
Figure 22:
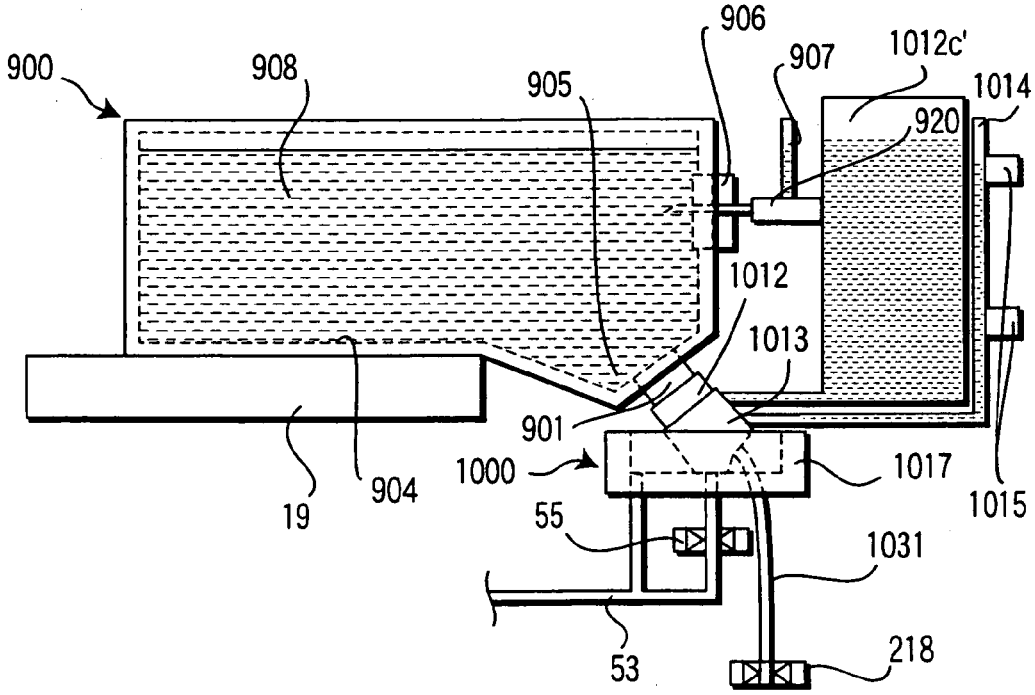
FIG. 22 is a schematic view showing a joint portion having a vent tube with a large capacity.

For example, as shown in FIG. 21, a vent tube 1012*c* which communicates with the outside can be formed to the ink residual quantity detection sensor portion 1000. When the electromagnetic valve 218 is opened, the ink in the vent tube 1012*c* also flows to the downstream side together with the ink in the ink bottle 900 due to a change in an air pressure in the ink supply path 200. If the ink in the vent tube 1012*c* flows out when the ink supply to the ink supply path 200 is performed for one time, air may possibly be supplied to the ink supply path 200 together with the ink from the ink bottle 900. In order to solve this problem, it is preferable that the capacity of the vent tube 1012*c* is increased so as to prevent the ink in the vent tube 1012*c* from running out when the ink supply is performed as shown in FIG. 22.

THIRD EMBODIMENT

Now, a structure of the ink residual quantity detection sensor portion 1000, for preventing an ink leakage at the times of an attachment of the ink bottle 900 and a detachment thereof in the third embodiment, will be described. The structural elements of the ink residual quantity detection sensor portion 1000 according to this embodiment, which are the same as those according to the first and second embodiments, are denoted by the same reference numerals as those denoting the structural elements of the first and second embodiments corresponding thereto, thereby eliminating the descriptions about them.

Figure 23:
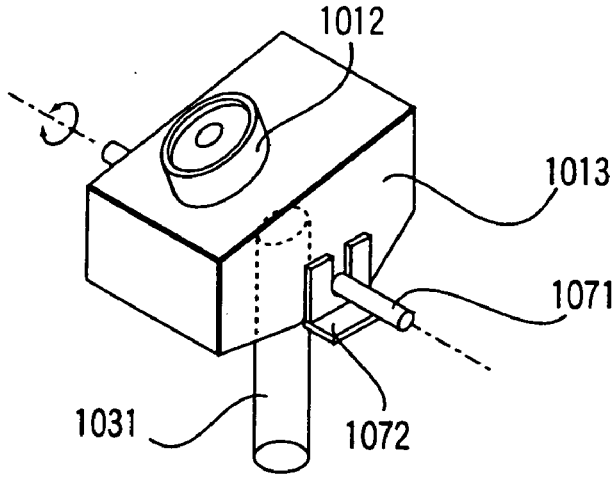
FIG. 23 is a perspective view of a printer side joint portion supported so as to be capable of swiveling around one axis.

As shown in FIG. 23, in the ink residual quantity detection sensor portion 1000 according to this embodiment, projections which can be rotary shafts 1071 are provided on side surfaces of the ink tank 1013. Further, the movable body 10 has bearing members 1072 which support the rotary shafts 1071. The bearing members 1072 supports the rotary shafts 1071 so as to be capable of swiveling around an axis orthogonal to the insertion direction of the ink bottle 900. With such a structure, the joint member 1012 can swivel around the axis orthogonal to the insertion direction of the ink bottle 900 in a plane which is in parallel with the insertion direction of the ink bottle 900.

For example, when a position or an angle of the outlet member 901 deviates from its standard in the ink bottles 900, or when a dimensional error is exists in the joint member of the ink residual quantity detection sensor portion 1000, the both members may not be coupled accurately with each other, which can be a factor of the ink leakage. However, since the joint member 1012 can swivel around one axis, the joint member 1012 can follow up the outlet member 901 by the displacement of the joint member 1012 and the both members can be easily and assurely coupled with each other even if there are irregularities in dimension or attachment as described above, thereby sufficiently reducing the ink leakage.

Figure 24:
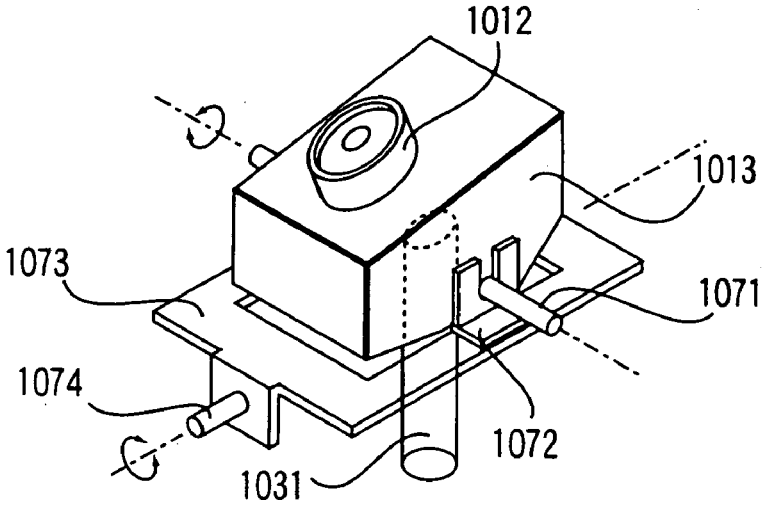
FIG. 24 is a perspective view of a printer side joint portion supported so as to be capable of swiveling around two axes orthogonal to each other.

Furthermore, as shown in FIG. 24, an ink residual quantity detection sensor portion 100 according to a modification of this embodiment comprises a bearing member base 1073 to which the bearing members 1072 are fixed, and rotary shafts 1074 orthogonal to the rotary shafts 1071, in addition to the rotary shafts 1071 and the bearing members 1072. Due to the rotary shafts 1071 and 1074, the ink residual quantity detection sensor 1000 can swivel the joint member 1012 around two axes orthogonal to each other.

With such a structure, the reliability of coupling between the outlet member 901 and the joint member 1012 can be further increased, and a quantity of the ink leakage can be reduced.

Moreover, it is preferable to attach the ink tank 1013 to the printer main body through an elastic member or the like in order to increase the reliability of coupling between the outlet member 901 and the joint member 1012. That is, due to a deformation of the elastic member, the ink tank 1013 and the joint member 1012 can displace with a relatively high degree of freedom, so that the joint member 1012 can follow up the outlet member 901 even if a position of the outlet member 901 deviates from its predetermined position. Additionally, since the joint member 1012 is pressed toward the outlet member 901 by the elastic force of the elastic member, coupling between them can be further strengthened, thereby sufficiently reducing the ink leakage.

By using the sponge 961, which is an ink absorber such as described in the second embodiment, in this embodiment, even if the ink adheres to the outlet member 901, the ink can be absorbed by the sponge, thus avoiding contaminations due to the adhered ink.

Further, although the rotary shafts 1071 and 1074 are provided to the ink tank 1013 in this embodiment, they may be provided to the waste ink pan 1017 which supports the ink tank 1013.

FOURTH EMBODIMENT

Now, a structure of the ink bottle 900, which can reduce an adverse affect resulting from the ink leakage at the times of an attachment of the ink bottle 900 and a detachment thereof in a fourth embodiment, will be described. The structural elements of the ink bottle 900 of this embodiment, which are the same as those according to the first and second embodiments, are denoted by the same reference numerals as those denoting the structural elements of the first and second embodiments corresponding thereto, thereby eliminating the descriptions about them.

Figure 25:
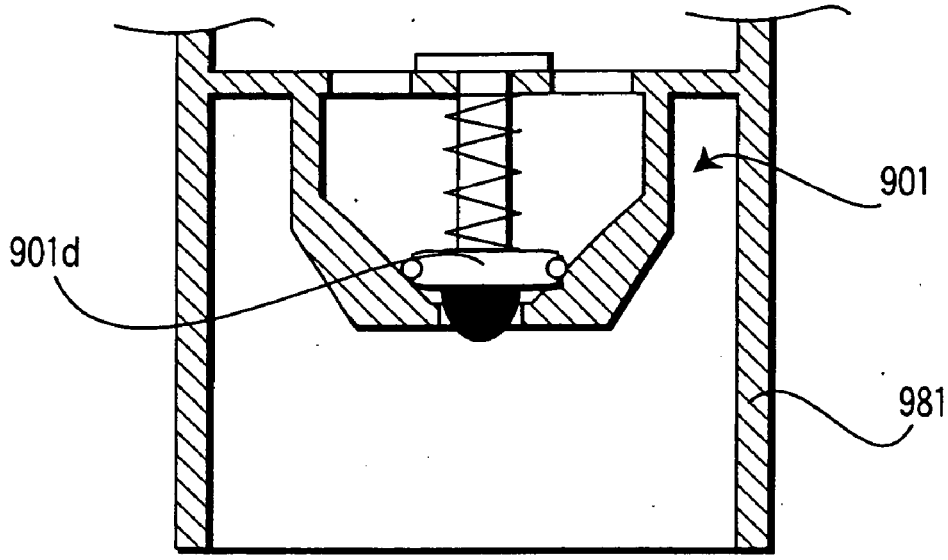
FIG. 25 is a cross-sectional view of an outlet member to which a cover is provided.

In this embodiment, as shown in FIG. 25, a cover 981 which surrounds the outlet member 901 of the ink bottle 900 is formed around the outlet member 901. This cover prevents a user from easily touching the outlet member 901 and the vicinity thereof, and a height of the cover 981 is set higher than at least a height of the outlet member 901.

By forming such a cover 981 around the outlet member 901, even if the ink adheres to the vicinity of the outlet member 901, a user cannot readily touch the outlet member 901, thereby reducing a contamination of the adhered ink to the hands of the user.

Figure 26:
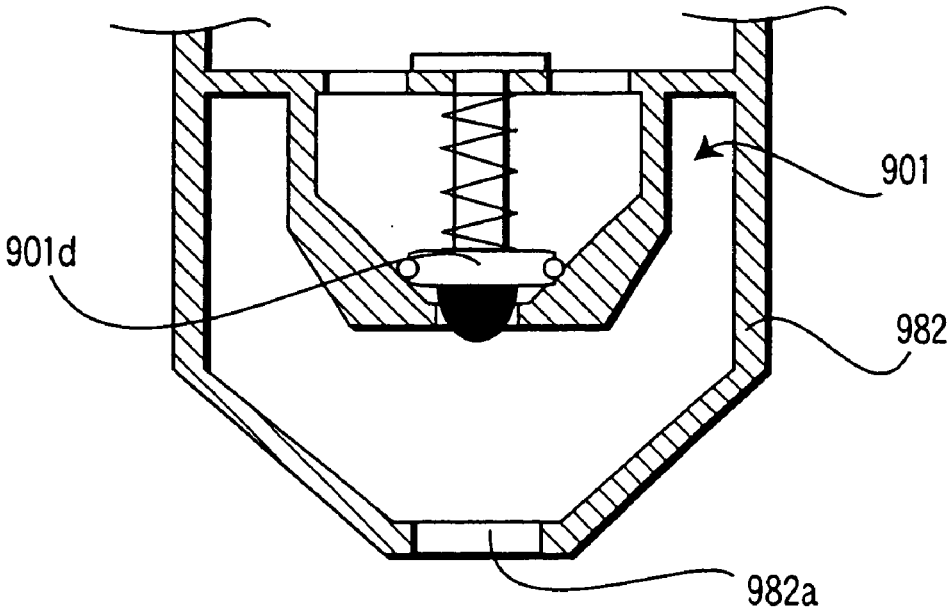
FIG. 26 shows a modification of the outlet member to which the cover is provided.
Figure 27:
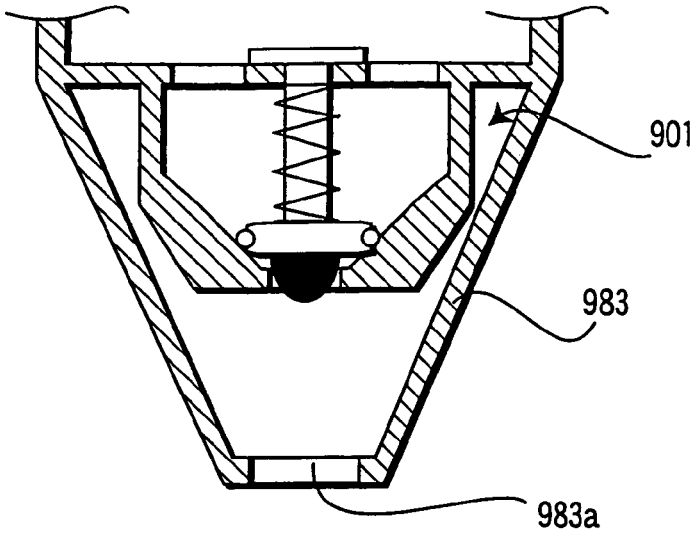
FIG. 27 is a cross-sectional view showing a modification of the outlet member to which the cover is provided.

A shape of the cover 981 can be appropriately changed. For example, as shown in FIGS. 26 and 27, covers 982 and 983 may be formed to cover not only the lateral side of the outlet member 901 but also the forward end side the outlet member 901. In this case, however, it is necessary to form holes 982*a* and 983*a* through which the pin at the end of the valve 1012*d* on the joint member 1012 can be inserted and which allow the pin to operate the valve 901*d* of the outlet member 901.

By forming the covers 982 and 983 to not only the lateral side of the outlet member 901 but also the forward end side of the outlet member 901, even if the ink adheres to the outlet member 901 and the vicinity thereof, a user cannot easily touch the outlet member 901, and an inconvenience that hands of the user are contaminated with the ink can be eliminated.

FIFTH EMBODIMENT

Figure 28:
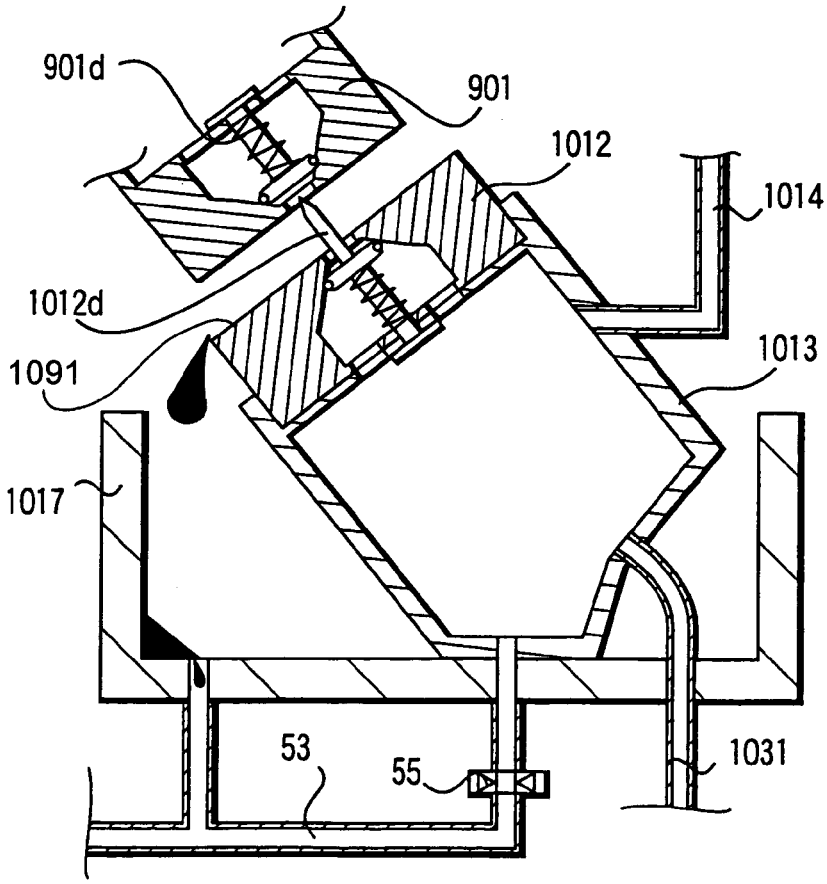
FIG. 28 is a schematic cross-sectional view showing a joint portion to which an inclined rib is formed and its periphery.

Now, a structure of the joint member 1012 on the printer side, which can prevent an ink leakage at the times of an attachment of the ink bottle 900 and a detachment thereof, in a fifth embodiment will be described with reference to FIG. 28.

The joint member 1012 according to this embodiment has a rib 1091 which leads the waste ink adhered to the coupling portion between the outlet member 901 and the joint member 1012 to the waste ink pan 1017.

This rib 1091 assuredly leads the ink leaked from the coupling portion to the waste liquid bottle, and prevents the leaked ink from contaminating the inside of the ink jet printer 1. This rib 1091 is inclined toward the waste ink pan 1017 so as to function as an ink flow path around the joint member 1012 below the coupling portion. Furthermore, a dimension of this rib 1091 is set in such a manner that a lower end thereof is positioned in the waste ink pan 1017.

By configuring in this manner, even if the ink leaks from the coupling portion between the ink bottle 900 and the joint member 1012, the leaked ink falls in the waste ink pan 1017 along the rib 1091. Then, the ink collected in this waste ink pan 1017 is further flowed toward the waste ink bottle 51 through the waste liquid path tube 53, as a waste ink.

According to this embodiment, even if the ink leaks from the joint member 1012 in this manner, the leaked ink is collected in the waste ink pan 1017, and hence the inside of the printer is not contaminated with the leaked ink. Moreover, since the rib 1091 as the leaked ink flow path is formed, the leaked ink can be assuredly collected in the waste ink pan 1017.

SIXTH EMBODIMENT

Now, a structure of the ink residual quantity detection sensor portion 1000 and that of the ventilation needle, both of which can prevent the ink leakage at the times of an attachment of the ink bottle 900 and a detachment thereof in a sixth embodiment with reference to FIGS. 29A to 29G. The structural elements of the ink residual quantity detection sensor portion 1000 and that of the ventilation needle in this embodiment, which are the same as those according to the first and second embodiments, are denoted by the same reference numerals as those denoting the structural elements of the first and second embodiments corresponding thereto, thereby eliminating the descriptions about them.

In this embodiment, as different from the foregoing embodiments, the front surface 907 of the ink bottle 900 in the insertion direction to the bottle holder 19 is configured to be in parallel with a surface which is substantially orthogonal to the insertion direction to the ink bottle 900, the rubber seal 906 into which the ventilation hollow needle 920 is inserted is provided at the upper portion of the front surface 907, and the outlet member 901 is provided at the lower portion of the front surface 907.

Additionally, corresponding to the structure of this ink bottle 900, each of the ventilation hollow needle 920 and the joint member 1012, both of which are on the printer side, is arranged along a direction parallel with the insertion direction of the ink bottle 900.

Further, the joint member 1012 and the ventilation hollow needle 920 are configured to be independently driven toward the ink bottle 900 inserted into the bottle holder 19.

Furthermore, an IC chip 1101, in which various kinds of data such as type or capacity of the ink is stored, is provided at a bottom surface of the ink bottle 900 used in this example, and a sensor 1102, which can read information stored in the IC chip 1101, is provided on the bottle holder 19 side of the printer. The sensor 1102 is connected with the control portion 40 (see FIG. 4).

The sensor 1102 can read various kinds of information stored in the IC chip 1101 when the ink bottle 900 inserted into the bottle holder 19 reaches a position at which it can be coupled with the joint member 1012. That is, the sensor 1102 can not only read various kinds of information about the ink bottle 900 but detects a completion of the insertion of the ink bottle 900 into the bottle holder 19.

Movement of the joint member 1012 and that of the ventilation hollow needle 920 are controlled on a basis of a detection result of this sensor 1102. Next, a process for an insertion, an attachment, and a removal of the ink bottle 900 will be described with reference to FIGS. 29A to 29G.

Figure 29A:
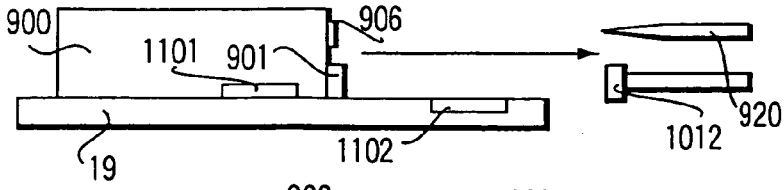
FIG. 29A is a view showing how communication of an ink flow path and ventilation are performed with respect to an ink bottle to be inserted into a bottle holder.
Figure 29B:
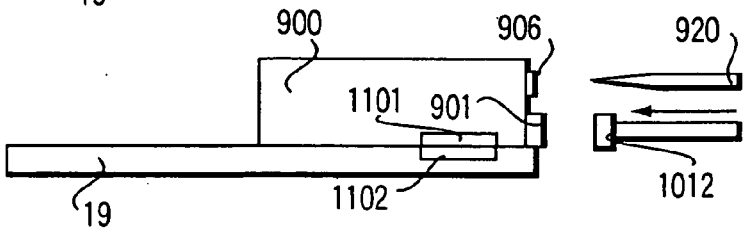
FIG. 29B is a view showing how communication of the ink flow path and ventilation are performed with respect to the ink bottle to be inserted into the bottle holder.

At first, the ink bottle 900 is inserted into the bottle holder 19 (FIG. 29A). At this time, the joint member 1012 and the ventilation hollow needle 920 are arranged at positions retracted backward (right side in the figure).

Moreover, the ink bottle 900 reaches an attachable position in the bottle holder 19 (FIG. 29B) at the end of the insertion. When the ink bottle 900 reaches the attachable position, the IC chip 1101 provided on the bottom surface of the ink bottle 900 faces the sensor 1102 provided on the bottle holder 19, and various kinds of information stored in the IC chip 1101 is read by the sensor 1102 and transmitted to the control portion 40.

Figure 29C:
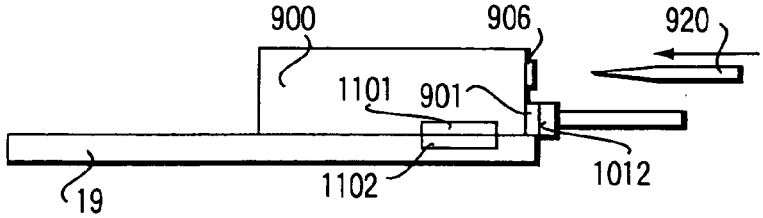
FIG. 29C is a view showing how communication of the ink flow path and ventilation are performed with respect to the ink bottle to be inserted into the bottle holder.

When the sensor 1102 detects a completion of the insertion of the ink bottle 900 and the control portion 40 detects that the inserted ink bottle 900 is appropriate, the joint member 1012 is moved firstly toward and coupled with the outlet member 901 so as to enable ink supply, by the control of the control portion 40 (FIG. 29C).

Figure 29D:
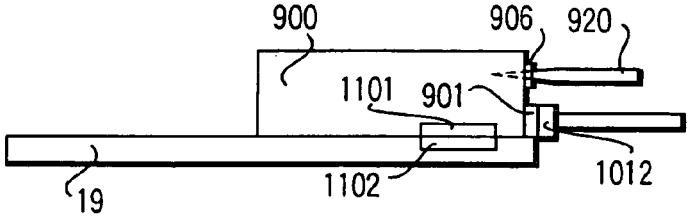
FIG. 29D is a view showing how communication of the ink flow path and ventilation are performed with respect to the ink bottle to be inserted into the bottle holder.
Figure 29E:
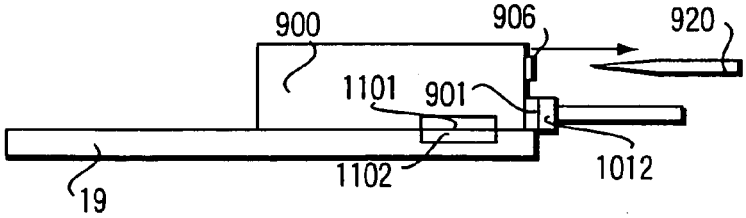
FIG. 29E is a view showing how communication of the ink flow path and ventilation are performed with respect to the ink bottle to be inserted into the bottle holder.

Then, upon a completion of the movement of the joint member 1012, the ventilation hollow needle 920 moves, pierces the rubber seal 906 provided on the front surface 907 of the ink bottle 900, and achieves ventilation (FIG. 29D).

After the attachment of the ink bottle 900 is completed by the above-described steps, the ink in the ink bottle 900 is supplied to the ink supply path 200 of the ink jet printer 1 from the outlet member 901 when the electromagnetic valve 218 provided on the ink supply path (see FIG. 2) is opened.

Figure 29F:
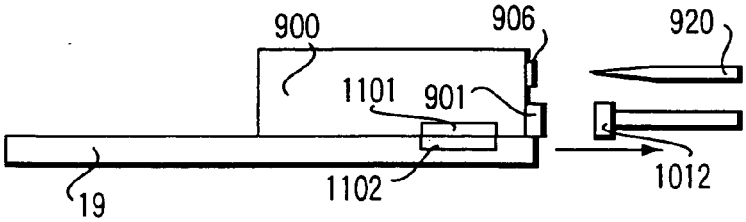
FIG. 29F is a view showing how communication of the ink flow path and ventilation are performed with respect to the ink bottle to be inserted into the bottle holder.
Figure 29G:
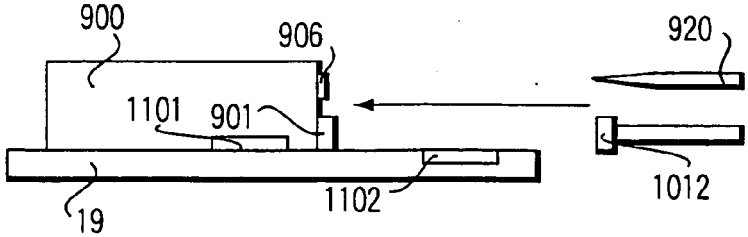
FIG. 29G is a view showing how communication of the ink flow path and ventilation are performed with respect to the ink bottle to be inserted into the bottle holder.

Now, a removal of the ink bottle 900 from the ink supply path 200 will be described. At first, the hollow needle 920 is moved and retracted before the joint member 1012 (FIG. 29E) is moved and retracted. Then, when the hollow needle 920 is pulled out from the rubber seal 906 and the hollow needle 920 reaches a position at which the inside of the ink bottle 900 is again sealed, the joint member 1012 is moved and retracted (FIG. 29F).

After the joint member 1012 reaches a position at which the joint member 1012 is separated from the outlet member 901, the ink bottle 900 is pulled out from the bottle holder 19. As clear from the above description, when attaching the ink bottle 900, ventilation of the ink bottle 900 is performed after the completion of the coupling between the joint member 1012 and the outlet member 901, thereby avoiding the ink leakage.

If this order is reversed, i.e., when the ventilation of the ink bottle is performed before the coupling of the joint member 1012 with the outlet member 901 is completed, the ink in the ink bottle 900 may possibly leak from the outlet member 901 due to its own weight, but such a leakage does not occur in this embodiment.

Additionally, when removing the ink bottle 900, the ventilation hollow needle 920 is removed firstly, the inside of the ink bottle 900 is maintained in a sealed state, and then the coupling between the joint member 1012 and the outlet member 901 is released, thereby avoiding the ink leakage.

If this order is reversed, i.e., when the coupling between the joint member 1012 and the outlet member 901 is released with the ink bottle 900 being ventilated, the ink in the ink bottle 900 may possibly leak from the outlet member 901 due to its own weight, and further the ink may be possibly discharged from the joint member 1012 while an ink level in the ink residual quantity detection communication tube 1014 or the vent tube 1012*c* is higher the joint member 1012. In this embodiment, however, since the ventilation hollow needle 920 is removed and the inside of the ink bottle 900 is maintained in the sealed state before the coupling of the joint member 1012 is released, thereby avoiding the above-described ink leakage.

In this embodiment, since the sensor 1102 is provided in a movement locus of the outlet member 901 when the ink bottle 900 is inserted and removed, detection of characteristics of the ink in the ink bottle becomes hard if the ink falls on the sensor 1102. According to this embodiment, however, as described above, the possibility of the ink leakage is low, and hence such an inconvenience can be prevented.

In this embodiment, the ink flow path between the ink bottle and the printer is formed by using the valve type joint and ventilation of the ink bottle is performed by the hollow needle in this embodiment, but the present invention is not restricted thereto. The ventilation may be achieved by a valve type joint, and the ink flow path may be formed by a hollow needle.

SEVENTH EMBODIMENT

Figure 30A:
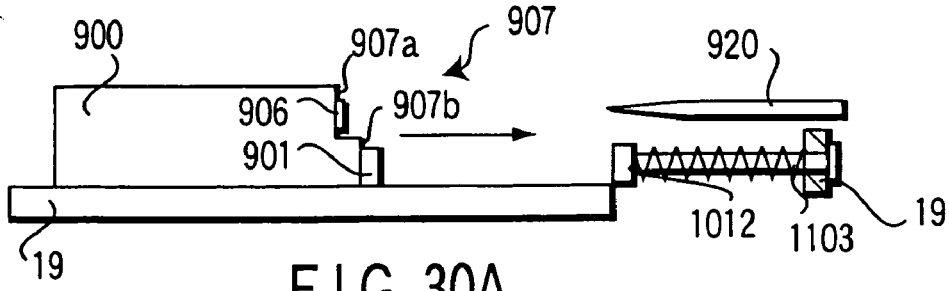
FIG. 30A is a view showing how communication of the ink flow path and ventilation are performed with respect to the ink bottle to be inserted into the bottle holder.
Figure 30B:
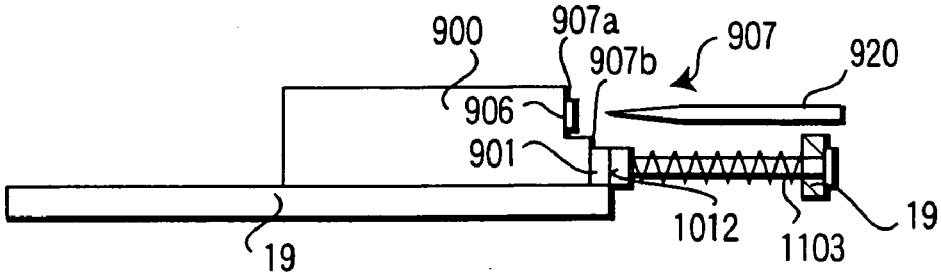
FIG. 30B is a view showing how communication of the ink flow path and ventilation are performed with respect to the ink bottle to be inserted into the bottle holder.
Figure 30C:
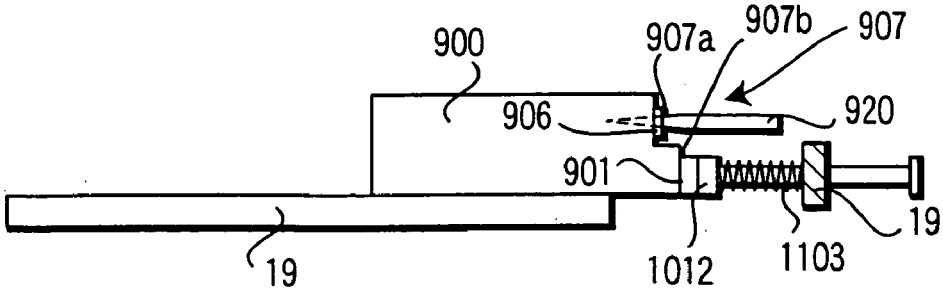
FIG. 30C is a view showing how communication of the ink flow path and ventilation are performed with respect to the ink bottle to be inserted into the bottle holder.

Now, a structure of the ink residual quantity detection sensor portion 1000 and that of the ventilation needle, both of which can prevent the ink leakage at the times of an attachment of the ink bottle 900 and a detachment thereof in a seventh embodiment with reference to FIGS. 30A to 30C. The structural elements of the ink residual quantity detection sensor portion 1000 and that of the ventilation needle in this embodiment, which are the same as those according to the first and second embodiments, are denoted by the same reference numerals as those denoting the structural elements of the first and second embodiments corresponding thereto, thereby eliminating the descriptions about them.

Like the sixth embodiment, this embodiment is configured in such a manner that the timing of the coupling of the joint member 1012 with the outlet member 901 at the time of attaching the ink bottle 900 is earlier than the timing of the ventilation, and that the timing of achieving air-tightness in the ink bottle 900 at the time of removing the ink bottle 900 is earlier than the timing of the separation of the joint member 1012 from the outlet member 901.

In this embodiment, the ventilation hollow needle 920 and the joint member 1012 are not driven, and the coupling and separation of the ink bottle 900 with and from the joint member 1012 and the insertion and removal of the hollow needle 920 to and from the ink bottle 900 are carried out by the insertion and removal operation of the ink bottle 900 with respect to the bottle holder 19.

The detailed structure will now be described hereinafter. In the ink bottle 900 used in this embodiment, the front surface 907 facing in the insertion direction to the bottle holder 19 has an upper portion 907*a* and a lower portion 907*b*. The lower portion 907*b* has a shape so as to protrude forward more than the upper portion 907*a*, and both the upper portion 907*a* and the lower portion 907*b* are configured to be parallel with a surface substantially orthogonal to the insertion direction of the ink bottle 900. The rubber seal 906 into which the ventilation hollow needle 920 is inserted is provided on the upper portion 907*a*, and the outlet member 901 is provided on the protruding lower portion 907*b*.

Further, corresponding to this structure of the ink bottle 900, each of the ventilation hollow needle 920 and the joint member 1012 on the printer side is arranged along a direction parallel with the insertion direction of the ink bottle 900.

The ventilation hollow needle 920 is fixed to the bottle holder 19. Furthermore, the joint member 1012 is supported by the bottle holder 19 so as to be movable in the direction parallel with the insertion and removal directions of the ink bottle 900, and urged in a direction toward the ink bottle 900 by a coil spring 1103. Therefore, while a load such as an external force is not applied on the joint member 1012, this joint member 1012 is urged in a direction toward the ink bottle 900 by the coil spring 1103.

Now, a process by which the ink bottle 900 is inserted into the bottle holder 19, the ink flow path is communicated with the ink bottle, and the ink bottle is ventilated will be described with reference to FIGS. 30A to 30C. FIG. 30A shows a state in which the ink bottle 900 starts to be inserted into the bottle holder 19.

After the ink bottle 900 is further inserted into the bottle holder 19 from this state, the outlet member 901 is coupled with the joint member 1012 urged toward the ink bottle 900 by the coil spring 1103 (FIG. 30B). At this time, the hollow needle 920 still cannot pierce the rubber seal 906 because the position of the upper portion 907*a* at which the rubber seal 906 of the ink bottle 900 is set back to the lower portion 907*b* at which the outlet member 901 is provided in the insertion direction of the ink bottle 900.

Then, when the ink bottle 900 is further inserted into the bottle holder 19 from this position, a force to insert the ink bottle 900 (a force in the rightward direction in the figure) overcomes the urging force (a force in the leftward direction in the figure) of the coil spring 1103, and the joint member 1012 is pushed toward its inner side (a right-hand side in the figure) of the bottle holder 19 while the coupling with the joint member 1012 is maintained.

Since the ink bottle 900 is inserted along non-illustrated guide means provided in the bottle holder 19, the coupling with the joint member 1012 has been maintained while the further insertion is performed.

As the ink bottle 900 is further inserted into the bottle holder 19 in this manner, the hollow needle 920 is inserted into the rubber seal 906 provided on the upper portion 907*a* of the ink bottle 900. When the ink bottle 900 reaches an attachment termination position, ventilation is completely achieved by the insertion of the hollow needle 920.

By appropriately setting a positional relationship between the rubber seal 906 of the ink bottle 900 and the outlet member 901 in the insertion direction of the ink bottle 900 and a positional relationship between the ventilation hollow needle 920 and the joint member 1012 in the insertion direction of the ink bottle 900 in this manner, the timing of the coupling of the joint member 1012 with the outlet member 901 while the attachment of the ink bottle 900 is performed can be set earlier than the timing of ventilation without driving the ventilation hollow needle 920 and the joint member 1012.

When the ink bottle 900 is removed from the bottle holder 19, the ventilation hollow needle 920 is removed firstly from the rubber seal 906, and an air-tightness is achieved in the ink bottle 900 (FIG. 30B). Then, the coupling between the joint member 1012 and the outlet member 901 is released and a state shown in FIG. 30A is achieved, thereby removing the ink bottle 900 from the bottle holder 19.

By configuring in this manner, the same advantages as those obtained in the sixth embodiment can be obtained. And, since the ventilation hollow needle 920 and the joint member 1012 are not driven, a manufacturing cost of this embodiment can be lowered.

As described above, in the ink jet printer according to each of the second to seventh embodiments, the ink leakage can be prevented, and the adverse affect of the leaked ink can be reduced.

As described above, in the ink jet printer according to each of the foregoing embodiments, the ink supply and ink filling from the ink bottle can be performed without using an ink supply pump.

Furthermore, air or air bubbles which have entered into the ink supply path or the ink jet head can be removed without using ink sucking means such as an ink suction cap.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink jet printer comprising:

a plurality of ink jet heads which record an image on a recording medium by ejecting ink;

an ink bottle in which the ink to be supplied to the ink jet heads is filled;

an ink supply path which is connected to the ink bottle and the ink jet heads so that the ink is flowable along an ink path therebetween; and an electromagnetic valve which is provided on the ink supply path and which is operable to open and close the ink path between the ink bottle and the ink jet heads, wherein the ink bottle, the electromagnetic valve and the ink jet heads are arranged in a vertical direction such that the ink jet heads are below the electromagnetic valve and the electromagnetic valve is below the ink bottle, wherein the ink supply path extends substantially upwards in the vertical direction along an entire length thereof such that air that enters the ink supply path moves upwards through the ink supply path to above the electromagnetic valve due to a difference in specific gravity between the air and the ink, wherein the ink supply path comprises a branching portion provided between the electromagnetic valve and the ink jet heads, and wherein a sub ink tank is provided at an end of the branching portion so as to be positioned lower than the ink jet heads in the vertical direction.

2. An ink jet printer according to claim 1, wherein the sub ink tank comprises an ink container formed of a flexible film.

3. An ink jet printer according to claim 2, wherein the ink bottle, the electromagnetic valve, the sub ink tank and the ink jet heads are mounted on a movable body.

4. An ink jet printer according to claim 3, wherein a plurality of said ink bottles for a plurality of types of ink for color printing, a plurality of said plurality of ink jet heads for the plurality of types of ink, and a plurality of said sub ink tanks for the plurality of types of ink are all mounted on the movable body.

5. An ink jet printer according to claim 3, wherein a bottom surface of the movable body comprises an inclined surface, and a concave portion which is formed at a lower part of the inclined surface in the vertical direction and which is used to collect the ink.

6. An ink jet printer according to claim 1, wherein the ink supply path comprises a hollow tube, and an inner diameter of the tube is not less than 6 mm.

7. An ink jet printer according to claim 6, wherein an inner surface of the tube has a low water repellency.

8. An ink jet printer according to claim 7, wherein the tube is formed of polyethylene.

9. An ink jet printer according to claim 8, wherein the tube is arranged at a predetermined angle to the vertical direction, said predetermined angle being larger than 0° but smaller than 90°.

10. An ink jet printer according to claim 1, further comprising a control circuit which controls an opening/closing operation of the electromagnetic valve, wherein the control circuit intermittently supplies the ink from the ink bottle by continuously repeating the opening/closing operation of the electromagnetic valve a plurality of times.

11. An ink jet printer according to claim 10, wherein:

an opening degree of the electromagnetic valve is changeable, the control circuit controls the opening degree of the electromagnetic valve, and when the electromagnetic valve is opened while the control circuit intermittently supplies the ink, the control circuit controls the opening degree to be smaller than a maximum opening degree of the electromagnetic valve.

12. An ink jet printer according to claim 1, further comprising:

an ink bottle side joint which is provided to an ink supply outlet of the ink bottle so as to enable air attachment and detachment of the ink bottle to and from the ink supply path, and an ink supply path side joint which is provided at one end of the ink supply path so as to enable attachment and detachment of the ink supply path to and from the ink bottle side joint, wherein the ink supply path side joint is supported so as to be capable of swiveling around a predetermined first axis.

13. An ink jet printer according to claim 12, wherein the ink supply path side joint is supported so as to be capable of swiveling around the predetermined first axis and a second axis orthogonal to the first axis.

14. An ink jet printer according to claim 1, further comprising:

an ink bottle side joint which is provided to an ink supply outlet of the ink bottle so as to enable attachment and detachment of the ink bottle to and from the ink supply path, an ink supply path side joint which is provided at one end of the ink supply path so as to enable attachment and detachment of the ink supply path to and from the ink bottle side joint, and a cover which surrounds the ink supply outlet and protrudes past an end edge of the ink supply outlet.

15. An ink jet printer according to claim 1, further comprising:

an ink bottle side joint which is provided to an ink supply outlet of the ink bottle so as to enable attachment and detachment of the ink bottle to and from the ink supply path, an ink supply path side joint which is provided at one end of the ink supply path so as to enable attachment and detachment of the ink supply path to and from the ink bottle side joint, a waste ink pan which is provided below a coupling portion between the ink bottle side joint and the printer side joint in a direction of gravity, and a waste ink flow path which leads ink leaked from the coupling portion to the waste ink pan.

16. An ink jet printer according to claim 15, wherein the waste ink flow path comprises an inclined rib which is provided to the ink supply path side joint, and wherein a lower end of the rib is positioned in the waste ink pan.

17. An ink jet printer according to claim 1, further comprising:

a unit which is provided on the ink supply path, supports the ink bottle so as to enable attachment and detachment of the ink bottle, and establishes communication of the ink path between the ink bottle and the ink supply path; and a unit which ventilates the ink bottle, wherein the communication of the ink supply path with the ink bottle is achieved before the ventilation of the ink bottle is performed, while the ink bottle is attached.

18. An ink jet printer according to claim 1, further comprising:

a unit which is provided on the ink supply path, supports the ink bottle so as to enable attachment and detachment of the ink bottle, and cancels communication of the ink path between the ink bottle and the ink supply path; and a unit which cancels a ventilation of the ink bottle, wherein the ventilation of the ink bottle is canceled before the communication of the ink path between the ink supply path and the ink bottle is canceled, while the ink bottle is removed.

19. An ink jet printer comprising:

a plurality of ink jet heads which record an image on a recording medium by ejecting ink;

an ink bottle in which the ink to be supplied to the ink jet heads is filled;

an ink supply path which is connected to the ink bottle and the ink jet heads so that the ink is flowable along an ink path therebetween; and an electromagnetic valve which is provided on the ink supply path and which is operable to open and close the ink path between the ink bottle and the ink jet heads, wherein the ink bottle, the electromagnetic valve and the ink jet heads are arranged in a vertical direction such that the ink jet heads are below the electromagnetic valve and the electromagnetic valve is below the ink bottle, wherein the ink supply path extends substantially downward in the vertical direction along an entire length thereof such that the ink from the ink bottle is supplied to the recording heads by its own weight when the ink path is opened by the electromagnetic valve, wherein the ink supply path comprises a branching portion provided between the electromagnetic valve and the ink jet heads, wherein a sub ink tank is provided at an end of the branching portion so as to be positioned lower than the ink jet heads in the vertical direction, wherein an ink bottle side joint is provided to an ink supply outlet of the bottle so as to enable attachment and detachment of the ink bottle to and from the ink supply path, and an ink supply path side joint is provided at one end of the ink supply path so as to enable attachment and detachment of the ink supply path to and from the ink bottle side joint, and wherein an ink absorbing member is provided to surround an ink supply opening in the ink supply outlet and is positioned inward of an outer edge of the ink supply outlet.

20. An ink jet printer according to claim 19, wherein when the ink bottle is attached to the ink supply path, the ink absorbing member is pressed by the ink supply path side joint.

21. An ink jet printer according to claim 20, further comprising a waste ink pan which collects ink pushed out from the ink absorbing member when the ink absorbing member is pressed.

* * * * *